US010603929B2

(12) United States Patent
Iwasaki et al.

(10) Patent No.: US 10,603,929 B2
(45) Date of Patent: Mar. 31, 2020

(54) DRYING DEVICE AND IMAGE FORMING APPARATUS

(71) Applicants: Ryota Iwasaki, Kanagawa (JP); Hiromi Sakaguchi, Kanagawa (JP); Yoshiki Yanagawa, Kanagawa (JP); Kaori Toyama, Kanagawa (JP); Satoshi Takahashi, Kanagawa (JP); Toshihiro Yoshinuma, Kanagawa (JP); Ken Onodera, Kanagawa (JP); Sho Sawahata, Tokyo (JP); Junji Nakai, Kanagawa (JP); Yasuhisa Katoh, Kanagawa (JP)

(72) Inventors: Ryota Iwasaki, Kanagawa (JP); Hiromi Sakaguchi, Kanagawa (JP); Yoshiki Yanagawa, Kanagawa (JP); Kaori Toyama, Kanagawa (JP); Satoshi Takahashi, Kanagawa (JP); Toshihiro Yoshinuma, Kanagawa (JP); Ken Onodera, Kanagawa (JP); Sho Sawahata, Tokyo (JP); Junji Nakai, Kanagawa (JP); Yasuhisa Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/130,046

(22) Filed: Sep. 13, 2018

(65) Prior Publication Data

US 2019/0084320 A1 Mar. 21, 2019

(30) Foreign Application Priority Data

Sep. 15, 2017 (JP) ..... 2017-178258
Jun. 14, 2018 (JP) ..... 2018-113732

(51) Int. Cl.
*B41J 11/00* (2006.01)
*B41J 15/04* (2006.01)

(52) U.S. Cl.
CPC ..... *B41J 11/002* (2013.01); *B41J 11/007* (2013.01); *B41J 15/04* (2013.01)

(58) Field of Classification Search
CPC ..... B41J 11/002; B41J 11/007; B41J 15/04
(Continued)

(56) References Cited

U.S. PATENT DOCUMENTS 9,908,342 B1 * 3/2018 Boland ..... B41J 11/002
2002/0033106 A1 * 3/2002 Ohba ..... B41J 11/002 101/225

(Continued)

FOREIGN PATENT DOCUMENTS

JP 2004-137048 5/2004
JP 2014-152964 8/2014

OTHER PUBLICATIONS

U.S. Appl. No. 15/913,842, filed Mar. 6, 2018, Satoshi Kitaoka, et al.

(Continued)

*Primary Examiner* — Huan H Tran
*Assistant Examiner* — Alexander D Shenderov
(74) *Attorney, Agent, or Firm* — Oblon, McClelland, Maier & Neustadt, L.L.P.

(57) ABSTRACT

A drying device includes heaters disposed along the direction of conveyance of a recording medium to which liquid is applied, the heaters being configured to heat the recording medium, wherein the recording medium is conveyed in contact with the heaters on a conveyance path including a first path on which the recording medium is conveyed in contact with the heaters for the second time and a second path on which the recording medium is conveyed in contact (Continued)

with the heaters for the second time, wherein a dried film of the liquid formed by the following method has a Martens hardness of 30 $N/mm^2$ or greater at 120 degrees C.:
method: the liquid is applied to a glass plate to form a film and the film is dried with a reduced pressure at 100 degrees C. for three hours to obtain the dried film having an average thickness of 5 μm.

17 Claims, 9 Drawing Sheets

(58) Field of Classification Search
USPC ..... 347/102
See application file for complete search history.

(56) References Cited

U.S. PATENT DOCUMENTS

2003/0108359 A1* 6/2003 Chung ..... G03G 15/234 399/124
2005/0076798 A1 4/2005 Sato et al.
2015/0298471 A1* 10/2015 Holtman ..... B41J 2/01 347/104
2017/0247556 A1 8/2017 Yokohama et al.
2017/0266990 A1 9/2017 Yoshinuma et al.
2017/0266991 A1 9/2017 Onodera et al.
2017/0267888 A1 9/2017 Yokohama et al.
2017/0334217 A1 11/2017 Yoshinuma et al.
2018/0009237 A1 1/2018 Sakamoto et al.
2018/0022114 A1 1/2018 Sakamoto et al.
2018/0030292 A1 2/2018 Gotou et al.
2018/0105711 A1 4/2018 Katoh et al.
2018/0126731 A1 5/2018 Ishikawa et al.

OTHER PUBLICATIONS

U.S. Appl. No. 15/913,830, filed Mar. 6, 2018, Yoshiaki Hoshino, et al.
U.S. Appl. No. 15/875,536, filed Jan. 19, 2018, Satoru Nagasawa, et al.

* cited by examiner

FIG. 7

| ROLLER DIAMETER (mm) | COCKLING HEIGHT (mm) | COCKLING PITCH (mm) | VISUALLY OBSERVED COCKLING |
|---|---|---|---|
| 250 | 0.11 | 5.0 | YES |
| 200 | 0.06 | 4.0 | YES |
| 150 | 0.06 | 4.5 | YES |
| 100 | 0.02 | NO PITCH | NONE |

DRYING DEVICE AND IMAGE FORMING APPARATUS

CROSS-REFERENCE TO RELATED APPLICATIONS

This patent application is based on and claims priority pursuant to 35 U.S.C. § 119 to Japanese Patent Application Nos. 2017-178258 and 2018-113732, filed on Sep. 15, 2017 and Jun. 14, 2018, respectively, in the Japan Patent Office, the entire disclosures of which are hereby incorporated by reference herein.

BACKGROUND

Technical Field

The present invention relates to a drying device and an image forming apparatus.

Description of the Related Art

Aqueous ink containing water is well known as ink for use in inkjet recording methods. To apply such an aqueous ink to a recording medium such as a continuous sheet continuously extending along the direction of conveyance using a high performance inkjet recording device, it is necessary to dry image portions formed with the aqueous ink applied to the recording medium in a short period of time. As the device to dry the image portions, for example, a contact heating device (contact heater) such as a heating roller is known.

SUMMARY

According to the present invention, provided is an improved, drying device which includes a plurality of heaters disposed along the direction of conveyance of a recording medium to which liquid is applied, the heaters being configured to heat the recording medium in a contact manner, wherein the recording medium is conveyed in contact with the heaters on a conveyance path including a first path on which the recording medium is conveyed in contact with the heaters for the first time and a second path on which the recording medium is conveyed in contact with at least one of the heaters for the second time, wherein a dried film of the liquid formed according to the following method has a Martens hardness of 30 $N/mm^2$ or greater at 120 degrees C.:

forming method: the liquid is applied to a glass plate to form a film and the film is dried with a reduced pressure at 100 degrees C. for three hours to obtain the dried film having an average thickness of 5 μm.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 7 is a table illustrating an example of the relation between the roller diameter of the heating roller and cockling of a continuous sheet;

Figure 1:
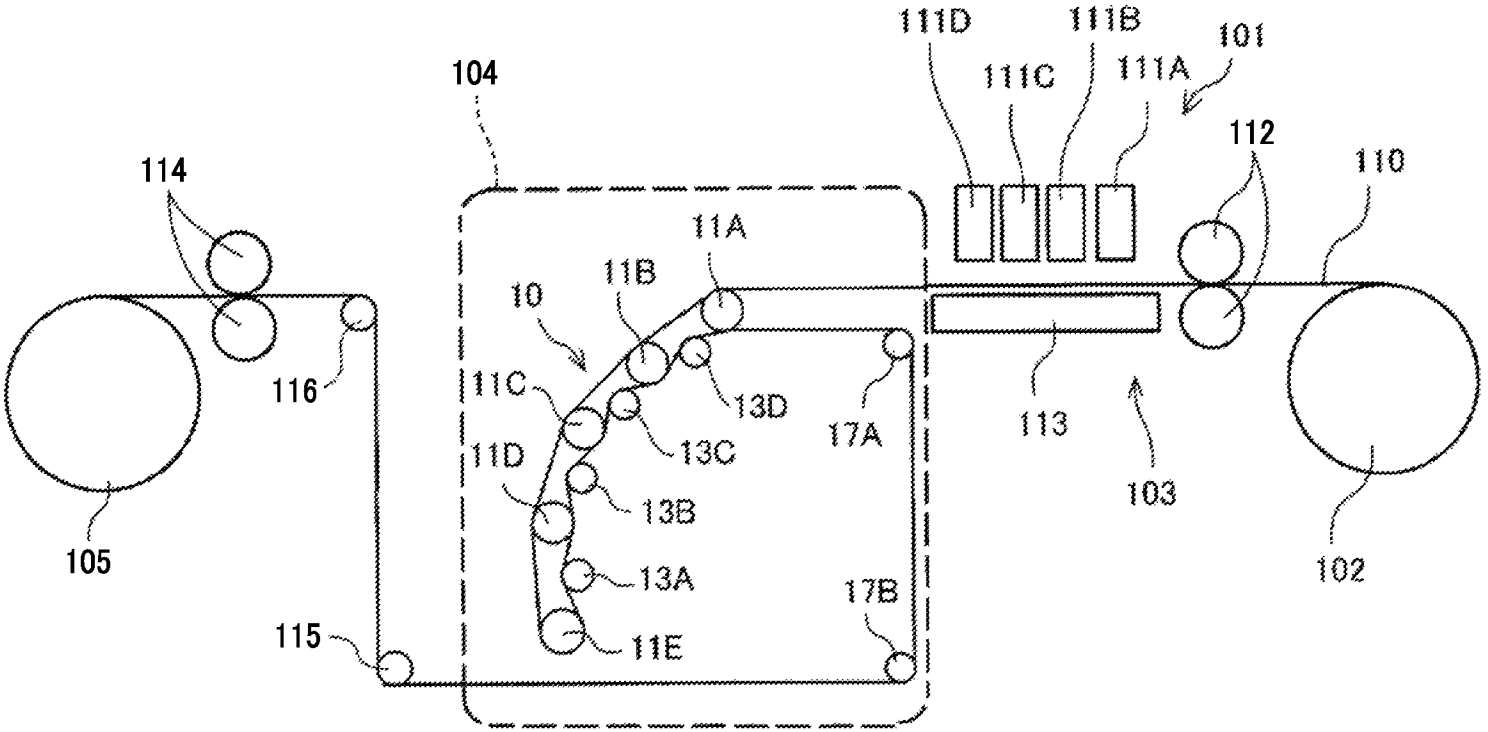
FIG. 1 is a schematic diagram illustrating an example of the image forming apparatus according to a first embodiment of the present disclosure.

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF THE EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Moreover, image forming, recording, printing, modeling, etc. in the present disclosure represent the same meaning, unless otherwise specified.

The drying device of the present disclosure is described below. It is to be noted that the following embodiments are not limiting the present disclosure and any deletion, addition, modification, change, etc. can be made within a scope in which man in the art can conceive including other embodiments, and any of which is included within the scope of the present disclosure as long as the effect and feature of the present disclosure are demonstrated.

For example, a drying device has been proposed which includes a heating roller to heat liquid matter applied substrate having a long band-like form wound around the exterior surface of the heating roller and at the same time rotationally convey along the conveyance path on the exterior surface and multiple conveying rollers disposed around the exterior surface of the heating roller to convey the substrate.

However, it requires a number of heating members to sufficiently dry the liquid applied area formed on a substrate (recording medium). In addition, if the liquid applied area contacts a member in the middle of conveyance, the area partially peels off, resulting in occurrence of voids regardless of whether the recording medium is sufficiently dried.

Drying Device

The drying device of the present disclosure includes a plurality of heaters disposed along the direction of conveyance of a recording medium to which liquid is applied, the heaters being configured to heat the recording medium in a contact manner, wherein the recording medium is conveyed in contact with the heaters on a conveyance path including a first path on which the recording medium is conveyed in contact with the heaters for the first time and a second path on which the recording medium is conveyed in contact with at least one of the heaters for the second time, wherein a dried film of the liquid formed according to the following method has a Martens hardness of 30 $N/mm^2$ or greater at 120 degrees C.

Forming Method

The liquid is applied to a glass plate to form a film and the film is dried with a reduced pressure at 100 degrees C. for three hours to obtain the dried film having an average thickness of 5 μm.

Regarding the drying device of the present disclosure, an image forming apparatus having the drying device is also described.

Next, the image forming apparatus relating to a first embodiment including the present disclosure is described with reference to FIG. 1. FIG. 1 is a schematic diagram illustrating an example of the image forming apparatus according to the first embodiment of the present disclosure.

This image forming apparatus is an inkjet recording device including a liquid application unit 101 including a liquid discharging head as an example of a liquid application device to discharge and apply ink as a predetermined color ink accommodated in a liquid accommodating container to a continuous sheet 110 as a member to be conveyed (recording medium). The liquid accommodating container is an example of a liquid accommodating device and can be. For example, an ink cartridge or an ink bottle.

The liquid application unit 101 includes, for example, four full line type heads 111A, 111B, 111C, and 111D (collectively referred to as head 111) disposed in this order from upstream of the continuous sheet 110 in the direction of conveyance. Each head 111 of the four heads individually discharges black K, cyan C, magenta M, and yellow Y to the continuous sheet 110. The kind and the number of colors are not limited thereto.

The liquid application unit 101 may be of a serial type in which a discharging head moves or a line type in which no discharging head moves. The liquid application unit 101 employs an inkjet recording method but can take another method. Specific examples include, but are not limited to, a blade coating method, gravure coating method, bar coating method, a roll coating method, a dip coating method, a curtain coating method, a slide coating method, die coating method, and a spray coating method.

The continuous sheet 110 is unreeled from a reel-down roller 102, sent out onto a conveyance guide 113 disposed facing the liquid application unit 101 by a conveyance roller 112 of a conveyance unit 103, and guided by the conveyance guide 113.

The continuous sheet 110 to which the liquid (ink) is applied by the liquid application unit 101 is sent to and reeled up by a reel-up roller 105 via a drying device 104 of the present disclosure and ejection rollers 114.

Figure 2:
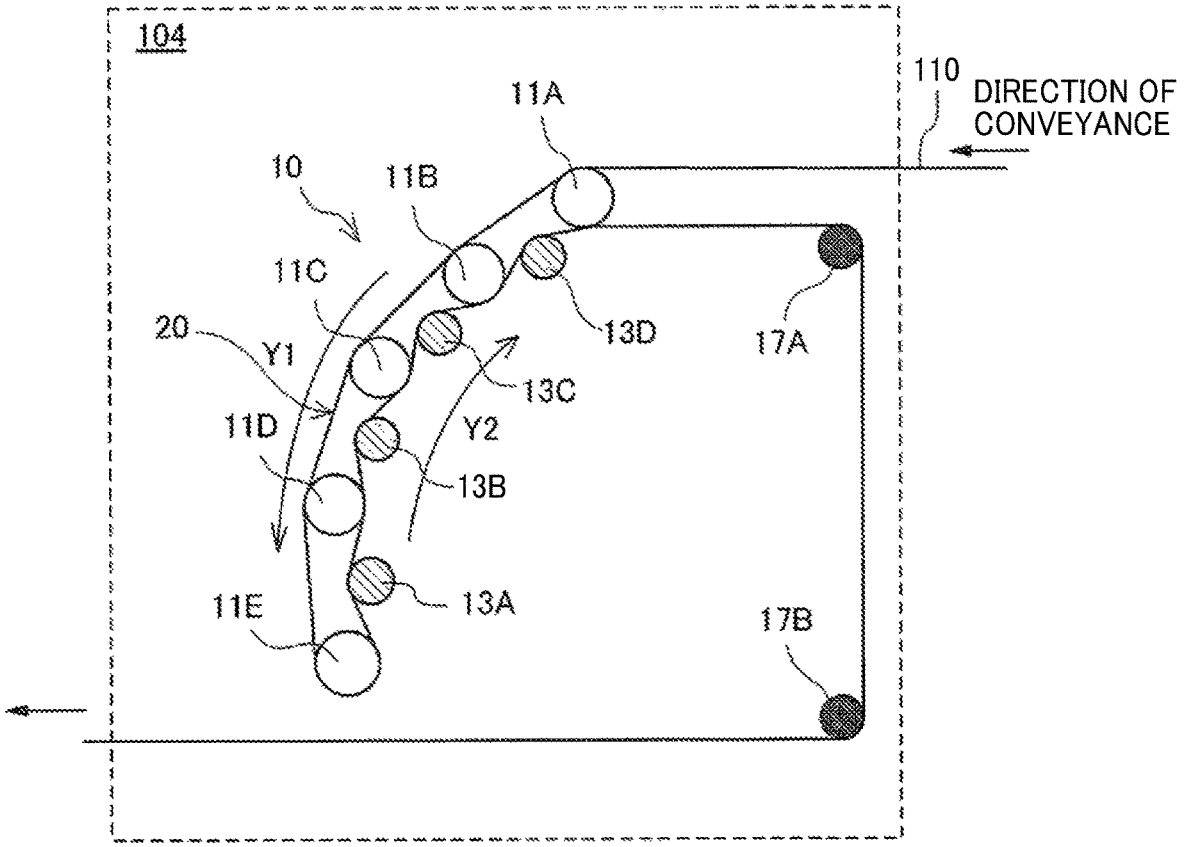
FIG. 2 is an enlarged diagram illustrating the drying device according to the first embodiment of the present disclosure.
Figure 3:
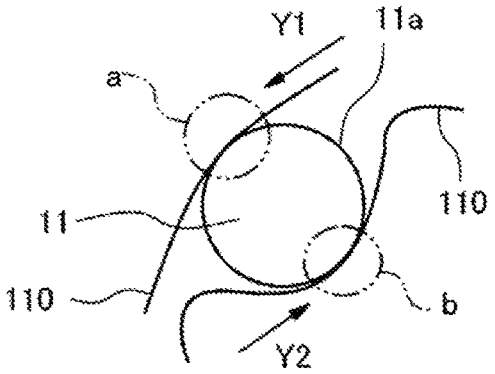
FIG. 3 is a diagram illustrating a description of the contact state to a heating roller.

Next, the drying device in the first embodiment is described with reference to FIG. 2 and FIG. 3. FIG. 2 is an enlarged diagram illustrating the drying device 104 in the first embodiment and FIG. 3 is a diagram illustrating a description of the contact portion of the continuous sheet 110 against a heating roller 11.

The drying device 104 includes a contact heater 10 to heat the continuous sheet 110 in contact with the opposite side to the side to which the liquid is applied. In addition, the drying device 104 also includes guiding rollers 17A and 17B to guide the continuous sheet 110 after the continuous sheet passes the contact heater 10.

The contact heater 10 includes heating rollers 11A to 11E (representatively referred to as heating roller 11) as examples of the multiple heaters each of which has a contact surface 11*a* having a curved form constituting the periphery in contact with the continuous sheet 110. In addition, the contact heater 10 includes contact guiding rollers 13A to 13D as an example of the contact guiding member to guide the continuous sheet 110 to contact the contact surface 11*a* of each of the heating rollers 11D to 11A.

The multiple heating rollers 11A to 11E are curvedly disposed. Each of the contact guiding rollers 13A to 13D is disposed between the adjacent heating rollers 11 and contacts the area to which the liquid is applied of the continuous sheet 110. Hereinafter, the area is described as the image portion as an example of the liquid applied area. The liquid applied area includes the portion of the surface of the recording medium (member to be conveyed) to which the liquid is applied and excludes the portion of the surface to which no liquid is applied.

The surface of the contact guiding roller 13 preferably has a fine concavo-convex (rough) structure. The roller having such a structure includes, for example, a roller in which a substantially spherical material adheres to the surface, a film in which a substantially spherical material adheres to the surface, and a roller covered with, for example, a tape. The substantially spherical material adhering to the surface is embedded in a roller, a film, a tape and is partially exposed from the surface to form a concavo-convex structure. The diameter of the substantially spherical material is preferably from 20 to 200 μm. The substantially spherical material can be made of, for example, glass, or ceramics. This contact guiding roller 13 having such a fine concavo-convex structure on the surface can reduce occurrence of voids representing partial peeling-off of the image portion caused by adhesion force between the image portion and the surface of the contact guiding roller 13 and contamination on members caused by the transfer of the component peeled off from the image portion.

In addition, the temperature of the image portion at the contact between the contact guiding roller 13 and the continuous sheet 110 is preferably from 60 to 120 degrees C. When the temperature of the image portion is 60 degrees C. or higher, the image portion can be dried at the same time with conveyance, thereby reducing the voids ascribable to insufficient drying at the image portion and the contamination on members. When the temperature of the image portion is 120 degrees C. or lower, the image portion not yet melted by heat can be brought into contact with the contact guiding roller 13, thereby preventing occurrence of voids and contamination on members.

In the drying device 104, a conveyance path 20 for the continuous sheet 110 is formed of these multiple heating rollers 11 and the contact guiding rollers 13.

This conveyance path 20 is separated into a first path (hereinafter referred to as first path Y1) along which the continuous sheet 110 is conveyed in a first direction (Y1 direction) in contact with the multiple heating rollers 11A to 11E for the first time and a second path (hereinafter referred to as second path Y2) along which the continuous sheet 110 is conveyed in a second direction (Y2 direction) in contact with the multiple heating rollers 11A to 11E for the second time.

In this embodiment, the continuous sheet 110 contacts two or more heating rollers 11 (first heating member) while the continuous sheet 110 is conveyed on the second path Y2. However, it may have a configuration in which only one heating roller 11 contacts on the second path Y2. In other words, when the continuous sheet 110 is conveyed on the second path Y2, the continuous sheet 110 does not necessarily contact all of the multiple heating rollers 11A to 11E on the second path Y2.

The continuous sheet 110 is conveyed along the outside of the arrangement of the multiple heating rollers 11A to 11E curvedly disposed on the first path Y1. The outside receives tensile force. Thereafter, the continuous sheet 110 continues to be conveyed along the inside of the arrangement of the multiple heating rollers 11A to 11E on the second path Y2 changing the direction of conveyance in contact with the heating rollers 11D to 11A, being guided by the contact guiding rollers 13 (13A, 13B, 13C, and 13D). The continuous sheet 110 slacks on the second path Y2.

As illustrated in FIG. 3, the continuous sheet 110 is conveyed on the first path Y1 and the second path Y2 at the same time in contact with the different portions (a portion and b portion) of the same heating roller 11.

That is, the recording medium (the continuous sheet 110) is conveyed and heated in contact with the two separate sites of the same heater (heating roller).

This configuration can efficiently dry the recording medium with a less number of heaters.

Figure 4:
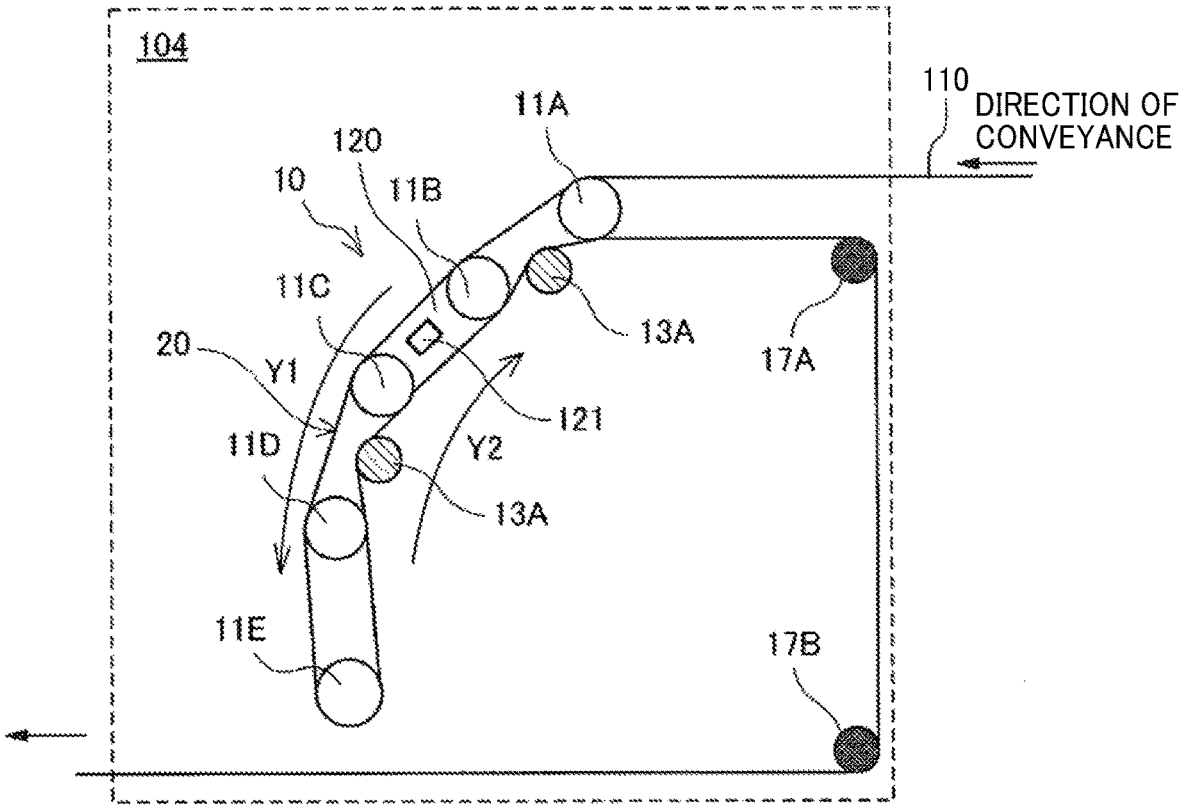
FIG. 4 is an enlarged diagram illustrating the drying device according to a second embodiment of the present disclosure.

Next, the second embodiment of the present disclosure is described with reference to FIG. 4. FIG. 4 is an enlarged diagram illustrating the drying device according to a second embodiment of the present disclosure.

In this embodiment, the configuration of the image forming apparatus is the same as that of the first embodiment except for the drying device 104.

In addition, unlike the drying device 104 of the first embodiment, the drying device 104 of the second embodiment includes the portion in which multiple heating rollers 11 (two in this embodiment) are disposed between the contact guiding rollers 13.

In such a configuration in which the contact guiding rollers 13 are differently disposed, the continuous sheet 110 can be guided and brought into contact with the heating rollers 11 on the second direction Y2 in accordance with the disposition of the heating roller 11 and the contact guiding roller 13.

Due to the disposition of the contact guiding rollers 13 in this embodiment, there is a portion where no contact guiding roller 13 is disposed between the heating rollers 11. A space 120 is formed between the continuous sheet 110 conveyed on the first path Y1 and the continuous sheet 110 conveyed on the second path Y2.

For example, a sensor unit to control the temperature of the heating roller 11 and a temperature control unit 121 can be disposed in this space 120.

Figure 5:
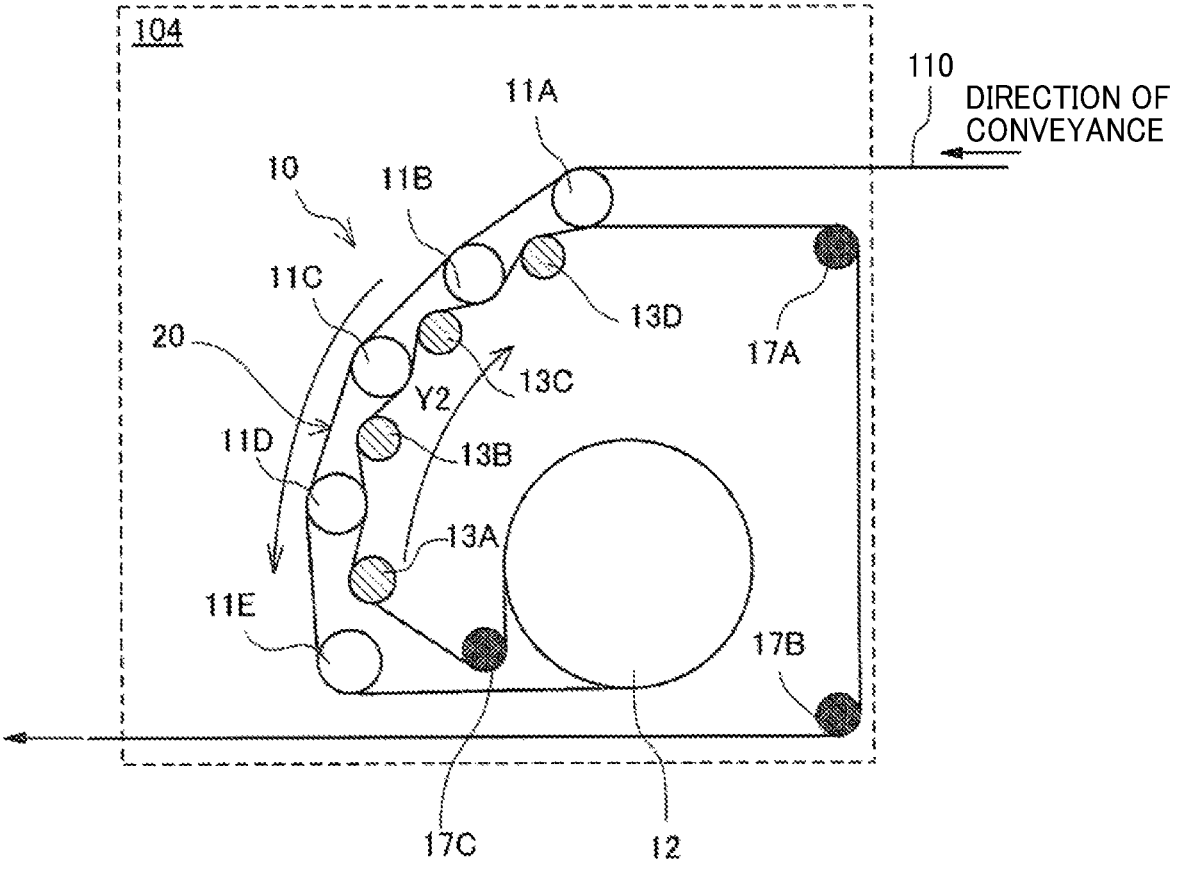
FIG. 5 is an enlarged diagram illustrating the drying device according to a third embodiment of the present disclosure.

Next, the third embodiment of the present disclosure will be described with reference to FIG. 5. FIG. 5 is an enlarged diagram illustrating the drying device of the third embodiment.

In this embodiment, the configuration of the image forming apparatus is the same as that of the first embodiment except for the drying device 104.

The drying device 104 includes a heating drum 12 as a second heating member disposed downstream of the heating rollers 11 on the first path Y1 and upstream on the second path Y2. The heating drum 12 has a contact surface (periphery) having a smaller curvature than that of the contact surface of the heating roller 11.

The heating drum 12 is rotationally driven, and the heating roller 11 is rotationally driven with the continuous sheet 110 being conveyed.

The continuous sheet 110 is wound around 70 percent or more, preferably 80 percent or more of the heating drum 12 on this conveyance path by the heating roller 11E, the heating drum 12, and the guiding roller 17. These heating drum 12 and the guiding roller 17 change the direction of conveyance of the continuous sheet 110 from the first path Y1 to the second path Y2.

At this point, the contact length of the continuous sheet 110 against the heating drum 12 is made longer than that against the heating rollers 11. The contact length means the length of the periphery of the continuous sheet 110 in contact with the heating drum 12 and the heating rollers 11 along the circumference direction (direction of conveyance) thereof. When the heating member has a curved portion as the contact surface, it means the length of the curved portion of the heating member along the periphery direction (direction of conveyance) of the curved surface in contact with the continuous sheet 110.

Figure 6A:
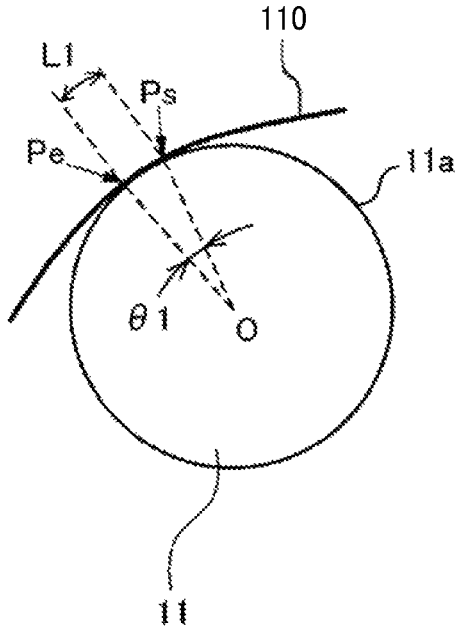
FIGS. 6A and 6B are diagrams illustrating a description of the contact length and winding angle of the heating roller and a heating drum.
Figure 6B:
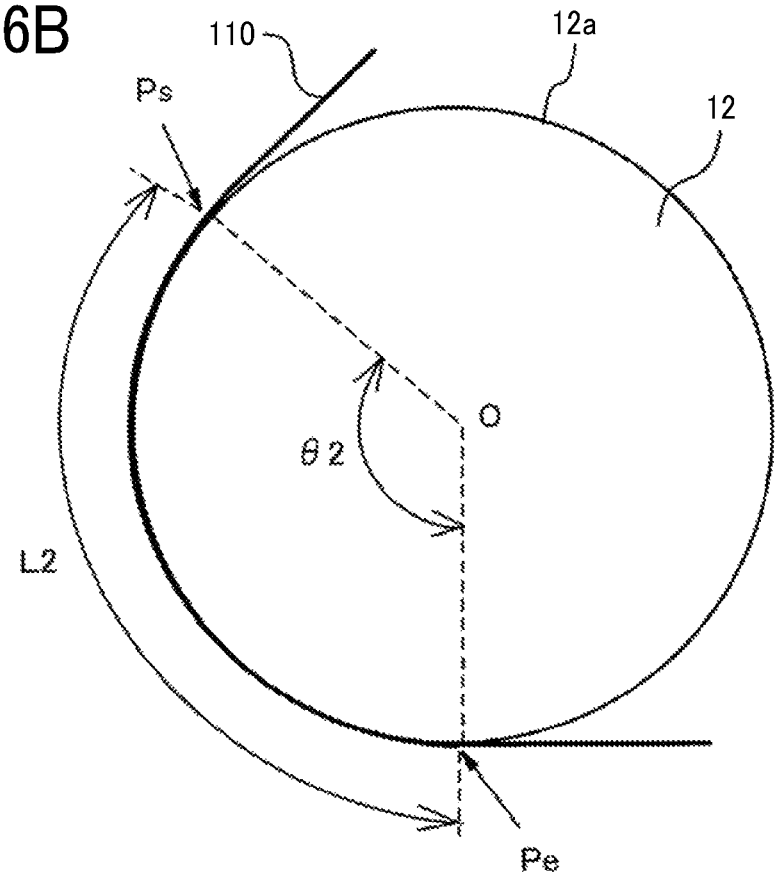

The contact length and the winding angle are described with reference to FIGS. 6A and 6B. FIG. 6A and FIG. 6B are diagrams illustrating a description of the contact length and the winding angle of the heating roller 11 and the heating drum 12, respectively.

As illustrated in FIGS. 6A and 6B, a contact length L2 of a contact surface 12*a* as the periphery of the heating drum 12 and the continuous sheet 110 is set to be longer than a contact length L1 of a contact surface 11*a* as the periphery of the heating roller 11 and the continuous sheet 110.

A winding angle θ2 of the continuous sheet 110 against the contact surface 12*a* of the heating drum 12 is set to be larger than a winding angle θ1 of the continuous sheet 110 against the contact surface 11*a* of the heating roller 11 (θ2>θ1).

The winding angles θ1 and θ2 (hereinafter collectively referred to as winding angle θ) are formed by a point Ps where the continuous sheet 110 starts contacting the contact surfaces 11*a* and 12*a* and a point Pe where the continuous sheet 110 starts being separated from the continuous sheet 110.

Therefore, as the winding angle θ increases, the contact length increases if the diameter of the rotary members is the same. In addition, if the winding angle is the same, as the diameter of the rotary member increases, the contact length increases.

In this embodiment, the diameter of the heating drum 12 is set to be greater than that of the heating roller 11. Also, the winding angle θ2 is set to be larger than the winding angle θ1. Therefore, the contact length L2 is greater than the contact length L1.

As described above, if the winding angles θ are the same, as the diameter of the rotary member increases, the contact length becomes longer. Accordingly, even under the condition that the diameters of the heating drum 12 and the heating roller 11 are the same and the winding angles θ2 is set to be greater than the winding angle θ2, the contact length L2 becomes longer than the contact length L1.

In this configuration, the heating drum 12 can provide a large amount of heat to heat and dry the continuous sheet 110 already heated by the heating roller 11 while being conveyed on the first path Y1.

In this case, cockling less occurs to the continuous sheet 110 immediately after the liquid is applied because the continuous sheet 110 is conveyed in contact with the heating roller 11. Also, since the continuous sheet 110 is wound round the heating drum 12 in such a state, the continuous sheet 110 adheres to the periphery of the heating drum 12 and can be efficiently dried.

Considering that the strength of the continuous sheet 110 deteriorates just after the liquid is applied thereto, it is difficult to make the rear side of the continuous sheet 110 adhere to a wide range (long contact length) of the periphery (contact surface) of the rotary member.

To deal with this, the winding angle of the continuous sheet 110 on the heating roller 11 is decreased to shorten the contact length in the initial state in which the applied liquid is not dried sufficiently.

Also, the curvature of the heating roller 11 is increased to change the tensile force occurring during the conveyance of the continuous sheet 110 to the pressing force at the contact portion with the heating roller 11, which brings the continuous sheet 110 into uniform contact with the heating roller 11. In this state, cockling or wrinkle of the continuous sheet 110 is less likely to occur to the continuous sheet 110 or corrected, so that heat required to uniformly dry the liquid on the continuous sheet 110 can be provided at the time of the continuous sheet 110 passing the multiple heating rollers 11.

If occurrence of cockling on the continuous sheet 110 is reduced and continuous sheet 110 is pretty dried, the continuous sheet 110 can adhere to the contact surface for a long contact length with the rotary member (curved surface).

Therefore, the heating drum 12 disposed downstream of the multiple heating rollers 11 has a long contact length with the continuous sheet 110 so that a large amount of heat is supplied to the continuous sheet 110 in a short time, which contributes to efficient drying.

A heating member such as the heating drum having a large diameter has a large contact area with a member (recording member) to which liquid is applied, thereby enhancing drying property. Also, the area to which liquid is applied is heated more. For example, when the area to which liquid is applied is brought into contact with a contact guiding member, images tend to be peeled off, resulting in voids. Therefore, the liquid applied to the member to be conveyed preferably has a Martens hardness in the following range.

Moreover, in this embodiment, the rear side of the continuous sheet 110 is brought into contact with the heating roller 11 again (for the second time) downstream of the heating drum 12.

Due to this, for example, moisture of the ink is evaporated by heat transfer of the heating roller 11 on the first path Y1 and heat transfer of the heating drum 12, and thereafter the solvent in the ink is evaporated by heat transfer of the heating roller 11 on the second path Y2 to fix the ink on sheet as the continuous sheet 110.

Next, an example of the relation between the roller diameter of the heating roller 11 and cockling of the continuous sheet 110 is described with reference to FIG. 7. FIG. 7 is a table illustrating an example of the relation of the roller diameter of the heating roller and cockling of continuous sheet.

The results of measuring the height and the pitch of cockling occurring to the continuous sheet 110 while changing the diameter of the heating roller 11 and the results of visible cockling are shown in FIG. 7.

As seen in the results shown in the table, in this example, when the diameter of the heating roller 11 is 200 mm, the height of cockling is half reduced in comparison with when the diameter of the heating roller 11 is 250 mm. Also, if the diameter of the heating roller 11 is 100 mm or less, cockling does not appear.

Therefore, the diameter of the heating roller 11 is preferably 200 mm or less and more preferably 100 mm or less.

Figure 8:
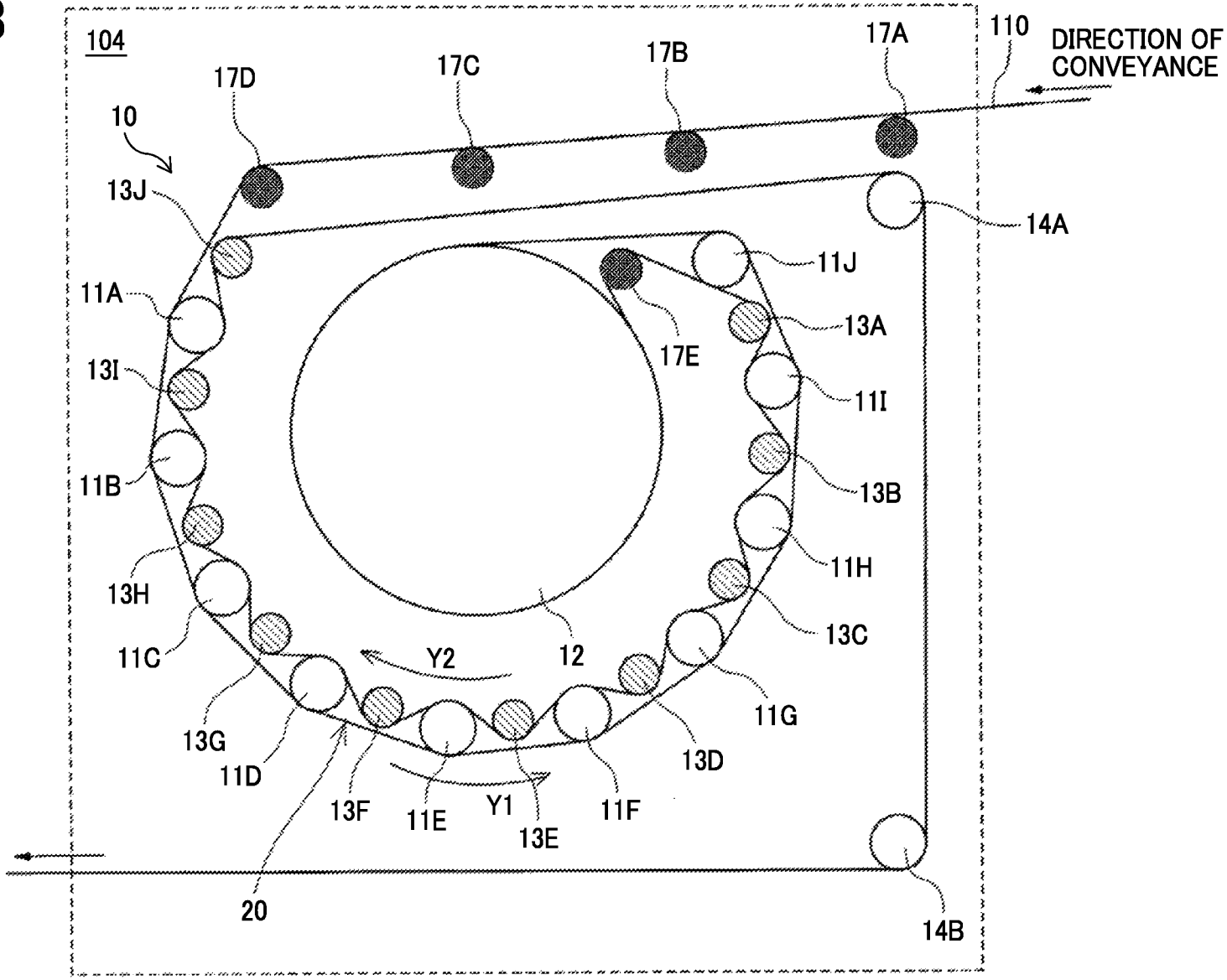
FIG. 8 is an enlarged diagram illustrating the drying device according to a fourth embodiment of the present disclosure.

Next, the fourth embodiment of the present disclosure will be described with reference to FIG. 8. FIG. 8 is an enlarged diagram illustrating the drying device of the fourth embodiment.

In this embodiment, the configuration of the image forming apparatus is the same as that of the first embodiment except for the drying device 104.

The drying device 104 includes ten heating rollers 11 (11A to 11J) constituting the contact heater 10, the heating drum 12, and the contact guiding rollers 13 (13A to 13J) to guide the continuous sheet 110 to be in contact with the heating rollers 11 (11A to 11J).

In addition, it also includes guiding roller 17A to 17D to guide the continuous sheet 110 to the contact heater 10 and a guiding roller 17E to wind the continuous sheet 110 around the heating drum 12. Moreover, it further includes heating rollers 14A and 14B also serving as guiding rollers to guide the continuous sheet 110 out of the contact heater 10.

The contact heater 10 includes the ten heating rollers 11 (11A to 11J) arcuately disposed around the heating drum 12. In FIG. 8, the center of the heating drum 12 is situated equidistant from the center of each of the heating rollers 11. However, it is not necessary to match the center of arc of the heating rollers 11 with the center of the heating drum 12.

Due to this, when the continuous sheet 110 is conveyed on the multiple heating rollers 11, the continuous sheet 110 can be conveyed with a suitable tensile force without a stress.

The continuous sheet 110 guided by the guiding roller 17D to the contact heater 10 is conveyed on the first path Y1 in contact with the outside (opposite side of the heating drum 12) of the arcuately disposed multiple heating rollers 11A.

Thereafter, the continuous sheet 110 reaches the periphery of the heating drum 12 and is wound round almost all of the periphery of the heating drum 12. Thereafter, it is guided to the heating roller 11J again by the guiding roller 17E and the contact guiding roller 13A. The continuous sheet 110 is guided to the inside (on the side of the heating drum 12) of the heating rollers 11J to 11A by the contact guiding rollers 13A to 13J and conveyed on the second path Y2.

This makes it possible to reduce the size of the device if the number of the heating member is increased. As the increased number of the heating members increases, the drying speed increases.

Figure 9A:
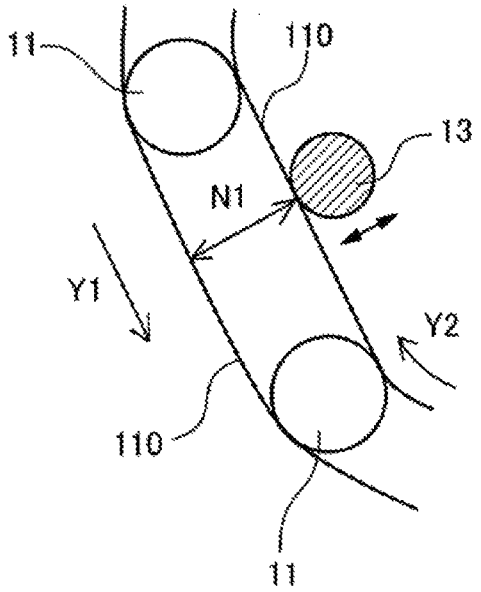
FIGS. 9A and 9B are diagrams illustrating an enlarged view of a part of the drying device according to a fifth embodiment of the present disclosure.
Figure 9B:
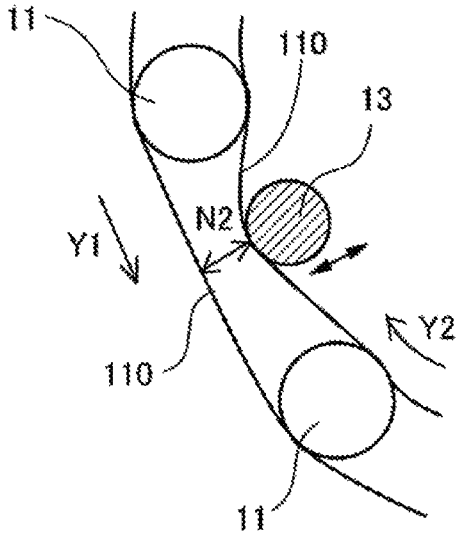

Next, the fifth embodiment of the present disclosure is described with reference to FIGS. 9A and 9B. FIGS. 9A and 9B are diagrams illustrating an enlarged view of a part of the drying device of the fifth embodiment.

In this embodiment, the contact guiding roller 13 placed between the adjacent heating rollers 11 is disposed movable along the direction indicated by the arrow between the first position illustrated in FIG. 9B where the continuous sheet 110 is pressed against the heating roller 11 and the second position illustrated in FIG. 9A where the continuous sheet 110 is not pressed against the heating roller 11. The contact guiding roller 13 can change its position against the conveyance path 20 on the outside of arrangement of the group of heating rollers 11.

The contact guiding roller 13 can be moved manually, for using a lever, or by an actuator using a drive source.

Due to such a configuration, to improve operability to initially load the continuous sheet 110, the contact guiding roller 13 can be retreated to a position away from the conveyance path 20 on the outside of the arrangement of the group of the heating rollers 11 in an amount of a distance N1.

After the continuous sheet 110 is loaded, the contact guiding roller 13 is moved to a pressing position the distance N2 (N2<N1) away from the outside conveyance path of the arrangement of the group of the heating rollers 11 to press in the continuous sheet 110 inside the external tangent of the adjacent heating rollers 11. This enlarges the contact area of the continuous sheet 110 against heating roller 11.

On the other hand, in this configuration of the contact guiding roller 13 pressing the continuous sheet 110, the contact guiding roller 13 presses the continuous sheet 110 in direct contact with the image formed thereon. To reduce occurrence of voids and contamination on members, the image portions are formed with liquid having a Martens hardness in the range specified later.

Figure 10:
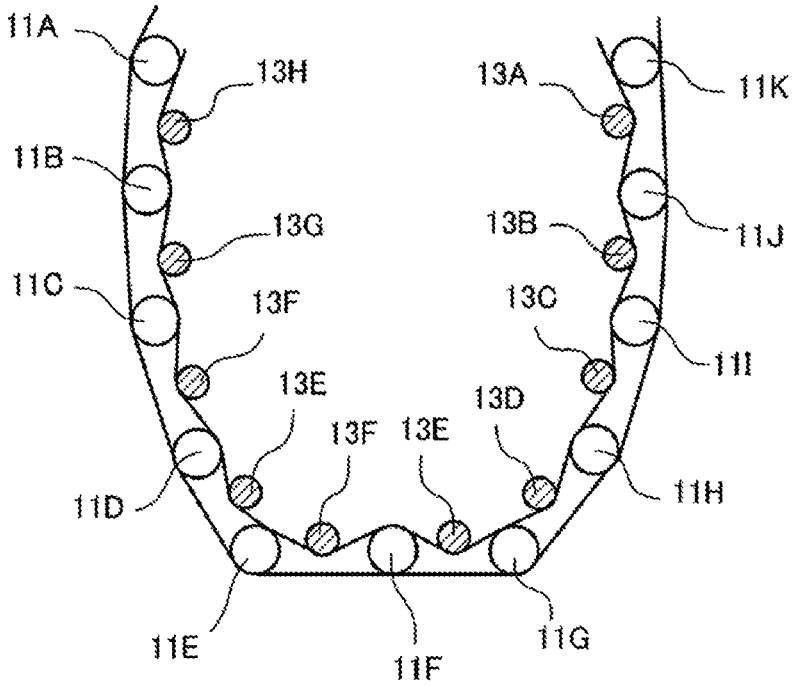
FIG. 10 is an enlarged diagram illustrating the drying device according to a sixth embodiment of the present disclosure.

Next, the sixth embodiment of the present disclosure will be described with reference to FIG. 10. FIG. 10 is a diagram illustrating an enlarged view of a part of the drying device of the sixth embodiment.

In this embodiment, the first heating rollers 11A to 11K and the contact guiding rollers 13A to 13H are disposed.

The heating rollers 11E, 11F, and 11G are disposed in a straight line to partially fold the conveyance path 20 so that the conveyance path 20 is formed of the arcuately disposed portions and the portion disposed in a straight line.

That is, the conveyance path 20 is not limited to the curved form but may partially include a straight form (straight path) as in this embodiment.

In the embodiment described above, the first heating members (the heating rollers 11A to 11K) and the second heating member (the heating drum 12) are rotary bodies but are not limited thereto. These can be partially or entirely non-rotary bodies.

In the embodiments described above, the conveyance path 20 is described having an arc form or a curved form but is not limited thereto. For example, a path folded in the middle along the Y1 direction (or the Y2 direction) or a crank path is also allowable.

In the embodiments described above, multiple first heating members are continuously disposed. However, it is possible to dispose a member such as a roller (rotary member) other than the heating member in the middle.

In addition, the image forming apparatus can apply liquid such as ink to form meaningful images such as texts or drawings and non-meaningful images such as decorative patterns on a recording medium.

In addition, in the embodiments described above, the second direction is just the opposite direction to the first direction, but is not limited thereto. The second direction may form an angle to the first direction.

Figure 11:
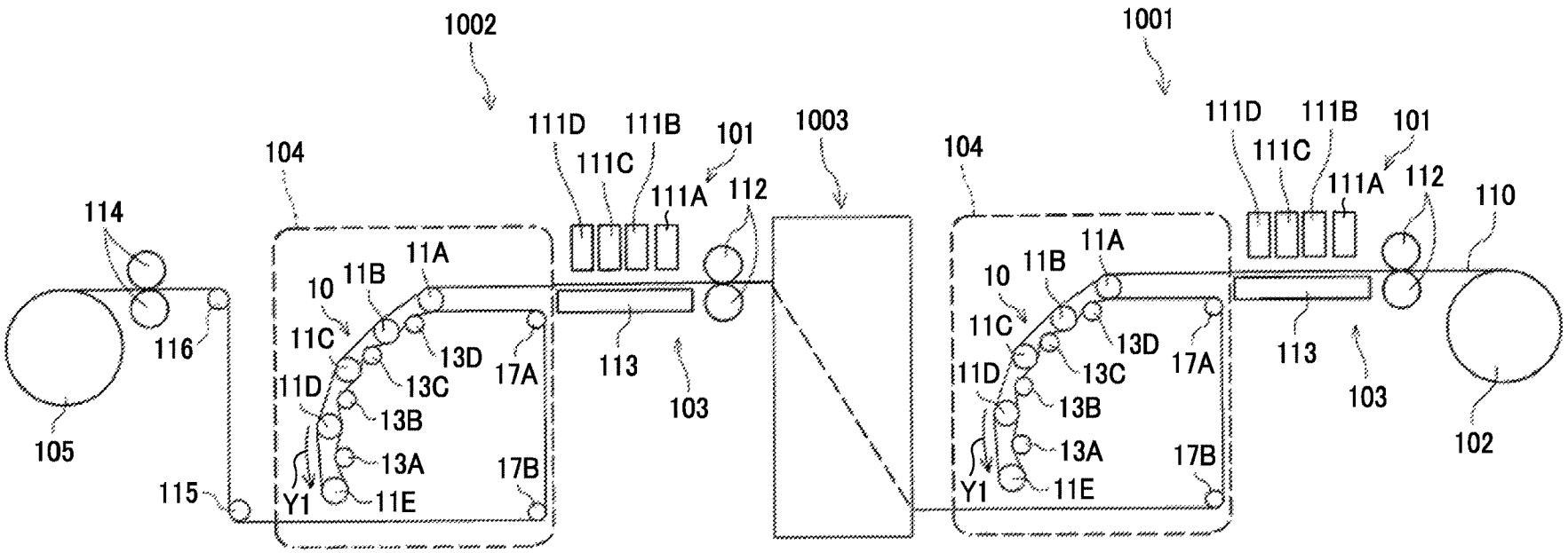
FIG. 11 is a schematic diagram illustrating an example of the image forming apparatus according to a seventh embodiment of the present disclosure.

Next, the image forming apparatus relating to the seventh embodiment including the present disclosure is described with reference to FIG. 11. FIG. 11 is a schematic diagram illustrating the image forming apparatus according to the seventh embodiment.

This image forming apparatus includes a first printing unit 1001 to print and dry an image on one side of the continuous sheet 110, a reverse unit 1003 to reverse the front and rear of the continuous sheet 110 having the printed image on one side by the first printing unit 1001, and a second printing unit 1002 to print and dry an image on the other side of the continuous sheet 110 between the reel-down roller 102 and the reel-up roller 105.

The configuration of the liquid application unit 101, the conveyance unit 103, and the drying device 104 of the first printing unit 1001 and the second printing unit 1002 can be almost or completely identical to that of the first embodiment. It can be also almost or completely identical to that of any one of the second to the sixth embodiment.

The liquid application unit 101 of the first printing unit 1001 is a first liquid application device to apply liquid to the first surface of the continuous sheet 110 as recording medium. The liquid application unit 101 of the second printing unit 1002 is a second liquid application device to apply liquid to the second surface opposite to the first surface of the continuous sheet 110 as recording medium.

In addition, the drying device 104 of the first printing unit 1001 is the first drying device in which the first surface of the continuous sheet 110 contacts the heating rollers 11 on the first path Y1. The drying device 104 of the second printing unit 1002 is the second drying device in which the second surface of the continuous sheet 110 contacts the heating rollers 11 on the first path Y1.

In the drying device 104 of the first printing unit 1001, the image portion is printed on only the first surface of the continuous sheet 110, so that the contact guiding roller 13 directly contacts the image portion. On the other hand, in the drying device 104 of the second printing unit 1002, the image portion is printed on both of the first surface and the second surface of the continuous sheet 110, so that both of the contact guiding roller 13 and the heating roller 11 directly contact the image portion. In other words, the chances of occurrence of voids and contamination on members increase, which increases necessity to reduce occurrence of voids and contamination on members by using liquid having a Martens hardness in the range specified later.

In the image forming apparatus relating to the first to sixth embodiment, the recording medium contacts the heating members with the surface to which no liquid is applied, but are not limited thereto. It can contact the heating members with the surface to which liquid is applied. For example, the surface to which no liquid is applied contacts the heating members on the first path and the surface to which liquid is applied contacts the heating members on the second path. The recording member is firstly dried from the surface to which no liquid is applied on the first path, thereby reducing occurrence of peeling-off of images caused by insufficiently dried image portion and the heating member, and thereafter the surface to which liquid is applied is directly heated on the second path. Therefore, good drying property is obtained.

In the image forming apparatus relating to the first to seventh embodiment, the continuous sheet is described as an example of members to be conveyed. The members are not limited thereto. For example, cut sheets can be used. When using cut sheets as the members to be conveyed, the cuts sheets can be conveyed using a suitable known method. For example, it is preferable to employ a method of sandwiching the both sides of the cut sheets with belts. Due to the belts, a tensile force can be applied in the direction of conveyance, thereby making the recording medium further adhere to heating rollers, which makes it possible to efficiently dry the recording medium. The cut sheets contact the heating rollers via the belt in this case.

Liquid

The liquid for use in the image forming apparatus having the drying device of the present disclosure is that dried film formed from the liquid by the following method has a Martens hardness of 30 N/mm$^2$ or greater at 120 degrees C.

Forming Method

Liquid is applied to a glass plate to form a film thereon and the film is dried with a reduced pressure at 100 degrees C. for three hours to obtain the dried film having an average thickness of 5 μm.

Ink, as one aspect of the liquid, is described below.

Martens Hardness

Martens hardness in an index representing hardness of material obtained in the indentation depth test. In this test, Vickers indenter is pressed in material to continuously measure the load test force and indentation depth to obtain the relation between the indentation depth and the test force. Martens hardness is obtained based on the slope of the indentation depth up to 50 percent value and 90 percent value of the maximum load test force of this curve in proportion to the root square of the load test force.

Martens Hardness of the dried film of the present disclosure is measured for the dried film formed by applying liquid onto a glass plate and drying the liquid with a reduced pressure at 30 degrees C. for three hours. The liquid is applied in such a manner that the average thickness of the dried film obtained after drying is 5 μm. The average means the average of thickness at ten points arbitrarily selected on the dried film. After cooling down this dried film to room temperature, the film is heated to 120 degrees C. and indented by Vickers indenter under a load of 0.5 mN in ten seconds, then held for five seconds, and the indenter was drawn in ten seconds using a micro hardness tester (HM-2000, manufactured by Helmut Fischer GmbH).

Martens hardness of the dried film measured according to this method is 30 N/mm$^2$ or greater, preferably 35 N/mm$^2$ or greater, and more preferably 50 N/mm$^2$. When Martens hardness is 30 N/mm$^2$ or greater, tacking force in the area to which liquid is applied on a member (recording medium) to be conveyed decreases and mechanical strength increases. Therefore, it is possible to reduce occurrence of voids ascribable to the contact of the member, for example, a contact guiding member, contacting the area to which the liquid is applied, with the area to which the liquid is applied. In addition, as described above, when the contact guiding member, etc. contacts the area to which liquid is applied, the area to which liquid is applied is already heated. Therefore, Martens hardness is measured for dried film at 120 degrees C. in accordance with the real state. Martens hardness of the dried film is preferably 120 N/mm$^2$ or less, more preferably 117 N/mm$^2$ or less, and furthermore preferably 89 N/mm$^2$ or less. When it is 120 N/mm$^2$ or less, abrasion resistance is enhanced, thereby reducing occurrence of contamination members.

In addition, in this embodiment, to efficiently heat the member to be conveyed, it is preferable to include multiple heating members disposed on conveyance path and multiple contact guiding members disposed between the heating members adjacent to each other on the conveyance path. Since the contact guiding member contacts multiple times the area of the member to be conveyed to which liquid is applied, voids tend to occur in comparison with the case in which the number of contacts is once. Therefore, when using such a drying device, it is more preferable that the liquid applied to the member to be conveyed satisfy the range of Martens hardness specified above to reduce occurrence of voids.

Next, the ink having a Martens hardness in the range specified above is described. The kind and the amount of resins in the ink in particular affect Martens hardness. The composition of the ink capable of having a Martens hardness in the range specified above is described next.

Organic Solvent

There is no specific limitation to the organic solvent for use in the present disclosure. For example, water-soluble organic solvents can be used. Examples are polyols, ethers such as polyol alkylethers and polyol arylethers, nitrogen-containing heterocyclic compounds, amides, amines, and sulfur-containing compounds.

Specific examples of the water-soluble organic solvent include, but are not limited to, polyols such as ethylene glycol, diethylene glycol, 1,2-propanediol, 1,3-propanediol, 1,2-butanediol, 1,3-butanediol, 1,4-butanediol, 2,3-butanediol, 3-methyl-1,3-butane diol, triethylene glycol, polyethylene glycol, polypropylene glycol, 1,2-pentanediol, 1,3-pentanediol, 1,4-pentanediol, 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butane triol, 1,2,3-butanetriol, 2,2,4-trimethyl-1,3-pentanediol, and petriol; polyol alkylethers such as ethylene glycol monoethylether, ethylene glycol monobutylether, diethylene glycol monomethylether, diethylene glycol monoethylether, diethylene glycol monobutylether, tetraethylene glycol monomethylether, and propylene glycol monoethylether; polyol arylethers such as ethylene glycol monophenylether and ethylene glycol monobenzylether; nitrogen-containing heterocyclic compounds such as 2-pyrolidone, N-methyl-2-pyrolidone, N-hydroxyethyl-2-pyrolidone, 1,3-dimethyl-2-imidazolidinone, ε-caprolactam, and γ-butyrolactone; amides such as formamide, N-methylformamide, N,N-dimethylformamide, 3-methoxy-N,N-dimethyl propionamide, and 3-buthoxy-N,N-dimethyl propionamide; amines such as monoethanolamine, diethanolamine, and triethylamine; sulfur-containing compounds such as dimethyl sulfoxide, sulfolane, and thiodiethanol; propylene carbonate, and ethylene carbonate.

To serve as a humectant and impart a good drying property, it is preferable to use an organic solvent having a boiling point of 250 degrees C. or lower.

Polyol compounds having eight or more carbon atoms and glycol ether compounds are also suitable. Specific examples of the polyol compounds having eight or more carbon atoms include, but are not limited to, 2-ethyl-1,3-hexanediol and 2,2,4-trimethyl-1,3-pentanediol.

Specific examples of the glycol ether compounds include, but are not limited to, polyol alkylethers such as ethylene glycol monoethylether, ethylene glycol monobutylether, diethylene glycol monomethylether, diethylene glycol monoethylether, diethylene glycol monobutylether, tetraethylene glycol monomethylether, and propylene glycol monoethylether; and polyol arylethers such as ethylene glycol monophenylether and ethylene glycol monobenzylether.

The polyol compounds having eight or more carbon atoms and glycol ether compounds enhance permeability of ink for paper used as a print medium (recording medium).

In particular, if the ink contains a resin, N,N-dimethyl-β-butoxy propionamide, N, N-dimethyl-β-ethoxy propionamide, 3-ethyl-3-hydroxymethyloxetane, and propylene glycol monomethylether are preferable. These can be used alone or in combination. If these are used with a resin, film-forming property of the resin is promoted, which makes it easier for the dried film to have a Martens hardness of 30 $N/mm^2$ or greater. However, the means to form a dried film having a Martens hardness of 30 $N/mm^2$ or greater is not limited to these solvents. When the mass ratio (amount of resin/amount of organic solvent) of the amount of the resin in ink and the total amount of N,N-dimethyl-β-butoxy propionamide, N,N-dimethyl-β-ethoxy propionamide, 3-ethyl-3-hydroxymethyl oxetane, and propylene glycol monomethylether in ink is from 0.86 and 1.60, Martens hardness of a dried film easily becomes 30 $N/mm^2$ or greater. However, the means to form a dried film having a Martens hardness of 30 $N/mm^2$ or greater is not limited to this mass ratio.

The boiling point of the organic solvent is preferably from 180 to 260 degrees C. When the boiling point is 180 degrees C. or higher, the evaporation speed during drying can be suitably controlled, the surface of a dried film is sufficiently leveled, thereby enhancing abrasion resistance. In addition, when the boiling point is 260 degrees C. or lower, drying property does not deteriorate, so that the drying time is not prolonged. According to the advancement of printing technologies, the time to be taken for drying becomes a rate limiting factor. Therefore, it is required to shorten the drying time and naturally drying taking a long time is not preferable.

The proportion of the organic solvent in the ink has no particular limit and can be suitably selected to suit to a particular application.

In terms of drying property and discharging reliability of ink, the proportion is preferably from 10 to 60 percent by mass and more preferably from 20 to 60 percent by mass.

Water

The proportion of water in the ink is not particularly limited and can be suitably selected to suit to a particular application. For example, in terms of the drying property and discharging reliability of the ink, the proportion is preferably from 10 to 90 percent by mass and more preferably from 20 to 60 percent by mass.

Coloring Material

The coloring material has no particular limit. For example, pigments and dyes are suitable.

As the pigment, inorganic pigments or organic pigments can be used. These can be used alone or in combination. In addition, it is possible to use a mixed crystal.

As the pigments, for example, black pigments, yellow pigments, magenta pigments, cyan pigments, white pigments, green pigments, orange pigments, gloss pigments of gold, silver, etc., and metallic pigments can be used.

As the inorganic pigments, in addition to titanium oxide, iron oxide, calcium carbonate, barium sulfate, aluminum hydroxide, barium yellow, cadmium red, and chrome yellow, carbon black manufactured by known methods such as contact methods, furnace methods, and thermal methods can be used.

As the organic pigments, it is possible to use azo pigments, polycyclic pigments (phthalocyanine pigments, perylene pigments, perinone pigments, anthraquinone pigments, quinacridone pigments, dioxazine pigments, indigo pigments, thioindigo pigments, isoindolinone pigments, and quinophthalone pigments, etc.), dye chelates (basic dye type chelates, acid dye type chelates, etc.), nitro pigments, nitroso pigments, and aniline black can be used. Of those pigments, pigments having good affinity with solvents are preferable. Also, hollow resin particles and hollow inorganic particles can be used.

Specific examples of the pigments for black include, but are not limited to, carbon black (C.I. Pigment Black 7) such as furnace black, lamp black, acetylene black, and channel black, metals such as copper, iron (C.I. Pigment Black 11), and titanium oxide, and organic pigments such as aniline black (C.I. Pigment Black 1).

Specific examples of the pigments for color include, but are not limited to, C.I. Pigment Yellow 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 138, 150, 153, 155, 180, 185, and 213; C.I. Pigment Orange 5, 13, 16, 17, 36, 43, and 51; C.I. Pigment Red 1, 2, 3, 5, 17, 22, 23, 31, 38, 48:2, 48:2 {Permanent Red 2B(Ca)}, 48:3, 48:4, 49:1, 52:2, 53:1, 57:1 (Brilliant Carmine 6B), 60:1, 63:1, 63:2, 64:1, 81, 83, 88, 101 (rouge), 104, 105, 106, 108 (Cadmium Red), 112, 114, 122 (Quinacridone Magenta), 123, 146, 149, 166, 168, 170, 172, 177, 178, 179, 184, 185, 190, 193, 202, 207, 208, 209, 213, 219, 224, 254, and 264; C.I. Pigment Violet 1 (Rhodamine Lake), 3, 5:1, 16, 19, 23, and 38; C.I. Pigment Blue 1, 2, 15 (Phthalocyanine Blue), 15:1, 15:2, 15:3, 15:4, (Phthalocyanine Blue), 16, 17:1, 56, 60, and 63; C.I. Pigment Green 1, 4, 7, 8, 10, 17, 18, and 36.

The dye is not particularly limited and includes, for example, acidic dyes, direct dyes, reactive dyes, basic dyes. These can be used alone or in combination.

Specific examples of the dye include, but are not limited to, C.I. Acid Yellow 17, 23, 42, 44, 79, and 142, C.I. Acid Red 52, 80, 82, 249, 254, and 289, C.I. Acid Blue 9, 45, and 249, C.I. Acid Black 1, 2, 24, and 94, C.I. Food Black 1 and 2, C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, 171, and 195, C.I. Reactive Red 14, 32, 55, 79, and 249, and C.I. Reactive Black 3, 4, and 35.

The proportion of the coloring material in the ink is preferably from 0.1 to 15 percent by mass and more preferably from 1 to 10 percent by mass in terms of enhancement of image density, fixability, and discharging stability.

To obtain an ink by dispersing a pigment, for example, a hydrophilic functional group is introduced into a pigment to prepare a self-dispersible pigment, the surface of a pigment is coated with a resin followed by dispersion, or a dispersant is used to disperse a pigment.

To prepare a self-dispersible pigment by introducing a hydrophilic functional group into a pigment, for example, it is possible to add a functional group such as sulfone group and carboxyl group to the pigment (e.g., carbon) to disperse the pigment in water.

To coat the surface of a pigment with a resin, the pigment is encapsulated by microcapsules to make the pigment dispersible in water. This can be referred to as a resin-coated pigment. In this case, all the pigments to be added to ink are not necessarily entirely coated with a resin. Pigments partially or wholly uncovered with a resin are allowed to be dispersed in the ink unless such pigments have an adverse impact.

In a method of using a dispersant to disperse a pigment, for example, a known dispersant having a small molecular weight or a large molecular weight, which is represented by a surfactant, is used to disperse the pigment in ink.

As the dispersant, it is possible to use, for example, an anionic surfactant, a cationic surfactant, a nonionic surfactant, an amphoteric surfactant, etc. depending on a pigment.

Also, a nonionic surfactant (RT-100, manufactured by TAKEMOTO OIL & FAT CO., LTD.) and a formalin condensate of naphthalene sodium sulfonate are suitable as the dispersant.

Those can be used alone or in combination.

Pigment Dispersion

The ink can be obtained by mixing a pigment with materials such as water and an organic solvent. It is also possible to mix the pigment with water, a dispersant, etc., to prepare a pigment dispersion and thereafter mix the pigment dispersion with material such as water and an organic solvent to manufacture the ink.

The pigment dispersion is obtained by mixing and dispersing water, a pigment, a pigment dispersant, and other optional components and controlling the particle size. It is good to use a dispersing device for dispersion.

The particle diameter of the pigment in the pigment dispersion has no particular limit. For example, the maximum frequency is preferably from 20 to 500 nm and more preferably from 20 to 150 nrn in the maximum number conversion to improve dispersion stability of the pigment and ameliorate discharging stability and the image quality such as image density. The particle diameter of the pigment can be measured using a particle size analyzer (Nanotrac Wave-UT151, manufactured by MicrotracBEL Corp).

In addition, the proportion of the pigment in the pigment dispersion is not particularly limited and can be suitably selected to suit a particular application. In terms of improving discharging stability and image density, the proportion is preferably from 0.1 to 50 percent by mass and more preferably from 0.1 to 30 percent by mass.

It is preferable that the pigment dispersion be filtered with a filter, a centrifuge, etc. to remove coarse particles followed by degassing.

Resin

The type of the resin contained in the ink has no particular limit and can be suitably selected to suit to a particular application. Examples are urethane resins, polyester resins, acrylic-based resins, vinyl acetate-based resins, styrene-based resins, butadiene-based resins, styrene-butadiene-based resins, vinyl chloride-based resins, acrylic styrene-based resins, and acrylic silicone-based resins.

Resin particles made of such resins may be also used. It is possible to mix a resin emulsion in which resin particles are dispersed in water as a dispersion medium with materials such as a coloring material and an organic solvent to obtain an ink. It is possible to use a suitably-synthesized resin particle. Alternatively, the resin particle is available on the market. These resin particles can be used alone or in combination.

Of these, urethane resin particles are preferable. Urethane resin particles have a great tacking force which contributes to forming of a tough dried film, thereby enhancing abrasion resistance. Therefore, occurrence of voids can be reduced. Moreover, when the glass transition temperature (Tg) of urethane resin particles is from −20 to 70 degrees C., abrasion resistance can be further enhanced.

In addition, of the resin particles specified above, acrylic resin particles have excellent abrasion resistance and discharging stability. Therefore, it is preferable to use it in combination with urethane resin particles.

The mass ratio (urethane resin particle/acrylic resin particle) of the amount (percent by mass) of the urethane resin particle to the total amount of ink to the amount (percent by mass) of the acrylic resin particle to the total amount of ink is preferably from 0.1 to 0.5. If the mass ratio (urethane resin particle/acrylic resin particle) is from 0.1 to 0.5, Martens hardness of dried film formed using ink easily becomes 30 $N/mm^2$ or greater. However, the means to form a dried film having a Martens hardness of 30 $N/mm^2$ or greater is not limited to this mass ratio of resins.

The volume average particle diameter of the resin particle is not particularly limited and can be suitably selected to suit to a particular application. The volume average particle diameter is preferably from 10 to 1,000 nm, more preferably from 10 to 200 nm, and furthermore preferably from 10 to 100 nm to obtain good fixability and image hardness.

The volume average particle diameter can be measured by using, for example, a particle size analyzer (Nanotrac Wave-UT151, manufactured by MicrotracBEL Corp.).

The proportion of the resin is not particularly limited and can be suitably selected to suit to a particular application. In terms of fixability and storage stability of ink, it is preferably from 1 to 30 percent by mass and more preferably from 5 to 20 percent by mass to the total amount of the ink.

The particle diameter of the solid portion in ink has no particular limit and can be suitably selected to suit to a particular application. For example, the maximum frequency in the maximum number conversion is preferably from 20 to 1,000 nm and more preferably from 20 to 150 nm to ameliorate the discharging stability and image quality such as image density. The solid portion includes resin particles, particles of pigments, etc. The particle diameter can be measured by using a particle size analyzer (Nanotrac Wave-UT151, manufactured by MicrotracBEL Corp).

Filler

The ink may contain a filler. If a filler having a higher hardness than the other components in the ink is contained in the area to which liquid id applied, it is easy to form a dried film having a Martens hardness of 30 $N/mm^2$ or greater. However, the means to form a dried film having a Martens hardness of 30 $N/mm^2$ or greater is not limited to using fillers. In addition, since fillers are contained in the area to which liquid is applied, the area contacting a member such as the contact guiding member which contacts the area to which liquid is applied can be reduced, thereby reducing occurrence of voids and contamination on members.

Inorganic pigments can be used as the filler.

Specific examples include, but are not limited to, white carbon (silicic acid fine powder), iron powder of iron oxides (red iron oxide, yellow oxide of iron, and black oxide of iron), copper powder, calcium carbonate, talc, and aluminum. Articles having a high hardness such as white carbon (silicic acid fine powder), iron powder of iron oxides (red iron oxide, yellow oxide of iron, and black oxide of iron), and copper powder are preferable. In addition, considering that fillers affect the color of ink, white pigment is preferable. However, colored pigments such as iron oxide can be usable as long as the color after addition of filler is checked. The proportion of the filler is preferably from 1.0 to 5.0 percent by mass to the total content of the ink. In addition, it is preferable that the volume average particle diameter (D90) is from 80 to 250 nm in terms of dischargeability.

Additive

Ink may further optionally include a surfactant, a defoaming agent, a preservative and fungicide, a corrosion inhibitor, a pH regulator, etc.

Surfactant

Examples of the surfactant are silicone-based surfactants, fluorochemical surfactants, amphoteric surfactants, nonionic surfactants, anionic surfactants, etc.

The silicone-based surfactant has no specific limit and can be suitably selected to suit to a particular application. Of these, preferred are silicone-based surfactants which are not decomposed even in a high pH environment.

Specific examples include, but are not limited to, side-chain-modified polydimethylsiloxane, both-distal-end-modified polydimethylsiloxane, one-distal-end-modified polydimethylsiloxane, and side-chain-both-distal-end-modified polydimethylsiloxane. A silicone-based surfactant having a polyoxyethylene group or a polyoxypropylene group as a modification group is particularly preferable because such an agent demonstrates good properties as an aqueous surfactant. It is possible to use a polyether-modified silicone-based surfactant as the silicone-based surfactant. A specific example is a compound in which a polyalkylene oxide structure is introduced into the side chain of the Si site of dimethyl siloxane.

Specific examples of the fluorochemical surfactants include, but are not limited to, perfluoroalkyl sulfonic acid compounds, perfluoroalkyl carboxylic acid compounds, ester compounds of perfluoroalkyl phosphoric acid, adducts of perfluoroalkyl ethylene oxide, and polyoxyalkylene ether polymer compounds having a perfluoroalkyl ether group in its side chain. These are particularly preferable because they do not easily produce foams.

Specific examples of the perfluoroalkyl sulfonic acid compounds include, but are not limited to, perfluoroalkyl sulfonic acid and salts of perfluoroalkyl sulfonic acid.

Specific examples of the perfluoroalkyl carboxylic acid compounds include, but are not limited to, perfluoroalkyl carboxylic acid and salts of perfluoroalkyl carboxylic acid.

Specific examples of the polyoxyalkylene ether polymer compounds having a perfluoroalkyl ether group in its side chain include, but are not limited to, salts of sulfuric acid ester of polyoxyalkylene ether polymer having a perfluoroalkyl ether group in its side chain and salts of polyoxyalkylene ether polymers having a perfluoroalkyl ether group in its side chain. Counter ions of salts in these fluorochemical surfactants are, for example, Li, Na, K, $NH_4$, $NH_3CH_2CH_2OH$, $NH_2(CH_2CH_2OH)_2$, and $NH(CH_2CH_2OH)_3$.

Specific examples of the amphoteric surfactants include, but are not limited to, lauryl amino propionic acid salts, lauryl dimethyl betaine, stearyl dimethyl betaine, and lauryl dihydroxyethyl betaine.

Specific examples of the nonionic surfactants include, but are not limited to, polyoxyethylene alkyl phenyl ethers, polyoxyethylene alkyl esters, polyoxyethylene alkyl amines, polyoxyethylene alkyl amides, polyoxyethylene propylene block polymers, sorbitan aliphatic acid esters, polyoxyethylene sorbitan aliphatic acid esters, and adducts of acetylene alcohol with ethylene oxides.

Specific examples of the anionic surfactants include, but are not limited to, polyoxyethylene alkyl ether acetates, dodecyl benzene sulfonates, laurates, and polyoxyethylene alkyl ether sulfates.

These can be used alone or in combination.

The silicone-based surfactant has no particular limit and can be suitably selected to suit to a particular application.

Specific examples include, but are not limited to, side-chain-modified polydimethyl siloxane, both distal-end-modified polydimethylsiloxane, one-distal-end-modified polydimethylsiloxane, and side-chain-both-distal-end-modified polydimethylsiloxane. In particular, a polyether-modified silicone-based surfactant having a polyoxyethylene group or a polyoxyethylene polyoxypropylene group is particularly preferable because such a surfactant demonstrates good property as an aqueous surfactant.

Any suitably synthesized surfactant and any product available on the market is suitable. Products available on the market can be obtained from Byc Chemie Japan Co., Ltd., Shin-Etsu Silicone Co., Ltd., Dow Corning Toray Co., Ltd., etc., NIHON EMULSION Co., Ltd., Kyoeisha Chemical Co., Ltd., etc.

The polyether-modified silicon-based surfactant has no particular limit and can be suitably selected to suit to a particular application. For example, a compound is usable in which the polyalkylene oxide structure represented by the following Chemical formula S-1 is introduced into the side chain of the Si site of dimethyl polysiloxane.

Chemical formula S-1

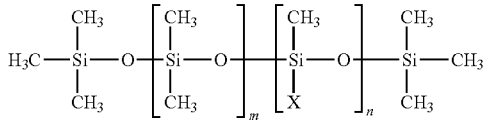

$X = -R(C_2H_4O)_a(C_3H_6O)_bR'$

In the Chemical formula S-1, "m", "n", "a", and "b" each, respectively independently represent integers, R represents an alkylene group, and R' represents an alkyl group.

Specific examples of polyether-modified silicone-based surfactants include, but are not limited to, KF-618, KF-642, and KF-643 (all manufactured by Shin-Etsu Chemical Co., Ltd.), EMALEX-SS-5602 and SS-1906EX (both manufactured by NIHON EMULSION Co., Ltd.), FZ-2105, FZ-2118, FZ-2154, FZ-2161, FZ-2162, FZ-2163, and FZ-2164 (all manufactured by Dow Corning Toray Co., Ltd.), BYK-33 and BYK-387 (both manufactured by BYK Japan KK.), and TSF4440, TSF4452, and TSF4453 (all manufactured by Momentive Performance Materials Inc.).

A fluorochemical surfactant in which the number of carbon atoms replaced with fluorine atoms is 2 to 16 is preferable and, 4 to 16, more preferable.

Specific examples of the fluorochemical surfactants include, but are not limited to, perfluoroalkyl phosphoric acid ester compounds, adducts of perfluoroalkyl ethylene oxide, and polyoxyalkylene ether polymer compounds having a perfluoroalkyl ether group in its side chain. Of these, polyoxyalkylene ether polymer compounds having a perfluoroalkyl ether group in its side chain are preferable because they do not foam easily and the fluorosurfactant represented by the following Chemical formula F-1 or Chemical formula F-2 is more preferable.

$$CF_3CF_2(CF_2CF_2)_m—CH_2CH_2O(CH_2CH_2O)nH$$ Chemical formula F-1

In the compound represented by Chemical formula F-1, "m" is preferably 0 or an integer of from 1 to 10 and "n" is preferably 0 or an integer of from 1 to 40.

$$C_nF_{2n+1}CH_2CH(OH)CH_2—O—(CH_2CH_2O)_a—Y$$ Chemical formula F-2

In the compound represented by the chemical formula F-2, Y represents H or $C_mF_{2m+1}$, where n represents an integer of from 1 to 6, or $CH_2CH(OH)CH_2—C_mF_{2m+1}$, where m represents an integer of from 4 to 6, or $C_pH_{2p+1}$, where p is an integer of from 1 to 19. "n" represents an integer of from 1 to 6. "a" represents an integer of from 4 to 14.

As the fluorochemical surfactant, products available on the market may be used. Specific examples include, but are not limited to, SURFLON S-111, SURFLON S-112, SURFLON S-121, SURFLON S-131, SURFLON S-132, SUR- FLON S-141, and SURFLON S-145 (all manufactured by ASAHI GLASS CO., LTD.); FLUORAD FC-93, FC-95, FC-98, FC-129, FC-135, FC-170C, FC-430, and FC-431 (all manufactured by SUMITOMO 3M); MEGAFACE F-470, F-1405, and F-474 (all manufactured by DIC CORPORATION); ZONYL TBS, FSP, FSA, FSN-100, FSN, FSO-100, FSO, FS-300, UR, and Capstone™ FS-30, FS-31, FS-3100, FS-34, and FS-35 (all manufactured by The Chemours Company); FT-110, FT-250, FT-251, FT-400S, FT-150, and FT-400SW (all manufactured by NEOS COMPANY LIMITED); POLYFOX PF-136A, PF-156A, PF-151N, PF-154, and PF-159 (manufactured by OMNOVA SOLUTIONS INC.); and UNIDYNE™ DSN-403N (manufactured by DAIKIN INDUSTRIES, Ltd.). Of these, in terms of improvement on print quality, in particular coloring property and permeability, wettability, and uniform dying property on paper, FS-3100, FS-34, and FS-300 of The Chemours Company, FT-110, FT-250, FT-251, FT-400S, FT-150, and FT-400SW of NEOS COMPANY LIMITED, POLYFOX PF-151N of OMNOVA SOLUTIONS INC., and UNIDYNE™ DSN-403N (manufactured by DAIKIN INDUSTRIES, Ltd.) are particularly preferable.

The proportion of the surfactant in ink is not particularly limited and can be suitably selected to suit to a particular application. For example, it is preferably from 0.001 to 5 percent by mass and more preferably from 0.05 to 5 percent by mass in terms of excellent wettability and discharging stability and improvement on image quality.

Defoaming Agent

The defoaming agent has no particular limit. For example, silicon-based defoaming agents, polyether-based defoaming agents, and aliphatic acid ester-based defoaming agents are suitable. These can be used alone or in combination. Of these, silicone-based defoaming agents are preferable in terms of the effect of foam breaking.

Preservatives and Fungicides

The preservatives and fungicides are not particularly limited. A specific example is 1,2-benzisothiazoline-3-one.

Corrosion Inhibitor

The corrosion inhibitor has no particular limitation. Specific examples include, but are not limited to, acid sulfites and sodium thiosulfates.

pH Regulator

The pH regulator has no particular limit as long as it can control pH to not lower than 7. Specific examples include, but are not limited to, amines such as diethanol amine and triethanol amine.

Properties of the ink are not particularly limited and can be suitably selected to suit to a particular application. For example, viscosity, surface tension, pH, etc., are preferable in the following ranges.

Viscosity of the ink at 25 degrees C. is preferably from 5 to 30 mPa·s and more preferably from 5 to 25 mPa·s to improve print density and text quality and obtain good dischargeability. Viscosity can be measured by, for example, a rotatory viscometer (RE-80L, manufactured by TOKI SANGYO CO., LTD.). The measuring conditions are as follows:

Standard cone rotor (1°34'×R24)

Sample liquid amount: 1.2 mL

Number of rotations: 50 rotations per minute (rpm)

25 degrees C.

Measuring time: three minutes

The surface tension of the ink is preferably 35 mN/m or less and more preferably 32 mN/m or less at 25 degrees C. in terms of suitable leveling of ink on a recording medium and shortening drying time of the ink.

pH of the ink is preferably from 7 to 12 and more preferably from 8 to 11 in terms of prevention of corrosion of metal material in contact with liquid.

The liquid mentioned above is preferably ink, but are not limited thereto. For example, pre-processing fluid and post-processing fluid are suitable.

The pre-processing fluid is applied to a member to be conveyed prior to the application of the ink. It is preferable that the pre-processing fluid can aggregate the component such as coloring material in the ink. The pre-processing fluid includes an organic solvent, water, a resin, an additive such as surfactant, and a flocculant. These organic solvent, water, resin, and additive such as surfactant are the same as those for use in the ink, and the description thereof is omitted. As the flocculant, known flocculants can be suitably used. For example, multivalent metal salts, organic acids, and cationic polymers are suitably selected.

The post-processing fluid is applied to a member to be conveyed after the application of the ink. It is preferable that the post-processing fluid can protect the image portion formed with the ink. The post-processing fluid includes an organic solvent, water, a resin, a filler, and an additive such as surfactant. These organic solvent, water, resin, filler, and additive such as surfactant are the same as those for use in the ink, and the description thereof is omitted.

In this embodiment, voids include the phenomenon that formed film with the pre-processing fluid or the post-processing fluid is peeled off in addition to peeling-off of the formed film with the ink.

Member to be Conveyed

There is no specific limitation to the recording medium as an example of the member to be conveyed and it can be suitably selected to suit to a particular application. For example, plain paper, gloss paper, special paper, cloth, film, transparent sheets, print sheets for general purpose, cut sheets, continuous sheets are suitable. The recording medium means an article to which ink or various processing fluids can be attached temporarily or permanently.

The recording medium is not limited to articles used as typical recording media. It is suitable to use building materials such as wall paper, floor material, and tiles, cloth for apparel such as T-shirts, textile, and leather as the recording medium. In addition, the configuration of the paths through which the recording medium is conveyed can be adjusted to use ceramics, glass, metal, etc.

In particular, the recording medium suitable for the present disclosure includes a substrate, a coated layer provided on at least one surface of the substrate, and other optional other layers.

The recording medium including the substrate and the coated layer preferably has a transfer amount of pure water to the recording medium is from 2 to 35 ml/m$^2$ and preferably from 2 to 10 ml/m$^2$ during a contact time of 100 ins as measured by a liquid dynamic absorption tester.

When the transfer amount of the ink and pure water during a contact time of 100 ms is too small, beading tends to occur. When the transfer amount is too large, the ink dot diameter after recording tends to be smaller than desired.

The transfer amount of pure water to the recording medium is from 3 to 40 ml/m$^2$ and preferably from 3 to 10 ml/m$^3$ during a contact time of 400 in as measured by a liquid dynamic absorption tester.

When the transfer amount of pure water during a contact time of 400 ms is too small, the drying property tends to deteriorate, resulting in occurrence of voids and contamination on members. When the transfer amount of pure water during a contact time of 400 ms is too large, the gloss of the area to which liquid is applied after drying tends to be low. The transfer amount of pure water to the recording medium during a contact time of 100 ms and 400 ms can be measured at the surface on which the coated layer is provided in both cases.

This dynamic scanning absorptometer (Kuga, Shigenori, Dynamic scanning absorptometer (DSA); Journal of JAPAN TAPPI, published in May 1994, Vol. 48, pp. 88-92) can accurately measure the imbibition liquid amount in an extremely small time period. Measuring is automated in this dynamic scanning absorptometer by the method of directly reading the absorption speed of liquid from moving of meniscus in a capillary and spirally scanning a sample having a disc-like form with an imbibition head, while automatically changing the scanning speed according to predetermined patterns to measure the necessary number of points of the single sample.

The liquid supply head to the paper sample is connected with the capillary via a TEFLON® tube and the position of the meniscus in the capillary is automatically read by an optical sensor.

Specifically, the transfer amount of pure water or ink can be measured using a dynamic scanning absorptometer (K350 Series D type, manufactured by Kyowa Seiko Inc.).

Each of the transfer amount during the contact time of 100 ms and 400 ms can be obtained by interpolation from the measuring results of the transfer amount in the proximity contact time of the contact time.

Recorded Matter

The recorded matter of the present disclosure includes a recording medium and an image formed on the recording medium with the ink. The member to be conveyed makes the recorded matter by an inkjet recording device and an inkjet recording method.

Having generally described preferred embodiments of this disclosure, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples but is not limited thereto.

Preparation Example of Pigment Dispersion

Preparation of Cyan Pigment Dispersion 20 g of Pigment Blue 15:3 (CHROMOFINE BLUE, manufactured by Dainichiseika Color & Chemicals Mfg. Co., Ltd.), 20 mmol of the compound represented by the following Chemical formula 1 illustrated below, and 200 mL of deionized highly pure water were mixed at room temperature using a Silverson Mixer (6,000 rpm) to obtain a slurry. When the obtained slurry had a pH higher than 4, 20 mmol of nitric acid was added. 30 minutes later, 20 mmol of sodium nitrite dissolved in a minute amount of deionized highly pure water was slowly added to the mixture. The system was stirred at 60 degrees C. to allow reaction for one hour, thereby obtaining a reformed pigment in which the compound represented by Chemical structure 1 was added to Pigment Blue. Thereafter, NaOH aqueous solution was added to adjust the pH to be 10 and 30 minutes later, a reformed pigment dispersion was obtained. This reformed pigment dispersion contained a pigment having at least one geminalbis phosphonic acid group or a sodium salt thereof. Thereafter, subsequent to ultrafiltration by dialysis membrane using the reformed pigment dispersion and highly deionized water followed by ultrasonic dispersion, cyan pigment dispersion having a pigment concentration of 15 percent by mass was obtained.

Chemical structure 1

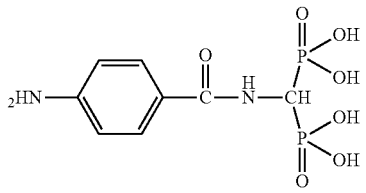

Preparation of Magenta Pigment Dispersion

A magenta pigment dispersion having a pigment concentration of 15 percent by mass was obtained in the same manner as in Preparation Example of Cyan Pigment Dispersion except that Pigment Blue 15:3 was replaced with Pigment Red 122 (Toner Magenta EO02, manufactured by Clariant Japan KK).

Preparation Example of Ink

Preparation of Ink 1

The following recipe was mixed and stirred and thereafter filtered by a polypropylene filter of 0.2 μm to prepare an ink 1. The amount of each component represents an amount of solid portion if clearly mentioned as solid portion and a total amount if not clearly mentioned as solid portion. In addition, the total amount of ink 1 is 100 parts.

| | |
|---|---|
| Cyan pigment dispersion: | 45.0 parts |
| Urethane resin particle 1: TAKELAC ™ W6110, glass transition temperature of −20 degrees C., manufactured by Mitsui Chemicals, Inc.): | 2.0 parts (solid portion) |
| Styrene acrylic resin particle (GRANDOL PP-1000EF, manufactured by DIC Corporation): | 5.0 parts (solid portion) |
| N,N-dimethyl-β-butoxy propionamide: | 5.0 parts |
| Diethylene glycol: | 15.0 parts |
| Zonyl FS-300: | 2.0 parts |
| Deionized water: | Balance |

Evaluation on Martens Hardness

Next, Ink 1 was applied to a glass plate and dried with a reduced pressure at 100 degrees C. for three hours to form a dried film having an average thickness of 5 μm. The average means the average thickness at ten points arbitrarily selected on the dried film. After cooling down this dried film to room temperature, the film was heated to 120 degrees C. and indented by Vickers indenter under a load of 0.5 mN in ten seconds, then held for five seconds, and the indenter was drawn in ten seconds using a micro hardness tester (HM-2000, manufactured by Helmut Fischer GmbH) to measure Martens hardness, which was 66 N/mm$^2$.

Preparation of Inks 2 to 11

Inks 2 to 11 were prepared in the same manner as in Preparation of Ink 1 except that the compositions and the proportions (percent by mass) were changed to those shown in the following Table 1. The amount of the urethane resin particle and the acrylic resin particle represents in solid and others are the entire addition amount. In addition, using the prepared Ink 2 to 11, Martens hardness was measured in the same manner as in Ink 1. The results are shown in Table 1.

TABLE 1

| | | Ink | | | | | |
|---|---|---|---|---|---|---|---|
| | | 1 | 2 | 3 | 4 | 5 | 6 |
| Coloring material | Cyan pigment dispersion | 45.0 | | 45.0 | | 45.0 | |
| | Magenta pigment dispersion | | 45.0 | | 45.0 | | 45.0 |
| Urethane resin particle | Urethane resin particle 1 (Tg: −20 degrees C.) | 2.0 | | | 2.0 | | |
| | Urethane resin particle 2 (Tg: 25 degrees C.) | | 2.0 | | | | 1.8 |
| | Urethane resin particle 3 (Tg: 90 degrees C.) | | | 2.0 | | 1.0 | |
| Acrylic resin particle | Styrene acrylic resin particle (Tg: 104 degrees C.) | 5.0 | 5.0 | 6.0 | | 5.0 | 4.0 |
| | Acrylic silicon resin particle (Tg: 0 degrees C.) | | | | 5.0 | | |
| Filler | White carbon pigment dispersion | | | | | | |
| Organic solvent | N,N-dimethyl-β-butoxy propionamide (*) | 5.0 | | | 5.0 | 7.0 | 6.0 |
| | N,N-dimethyl-β-ethoxy propionamide (*) | | 5.0 | | | | |
| | 3-ethyl-3-hydroxymethyl oxetane (*) | | | 5.0 | | | |
| | Diethylene glycol | 15.0 | 15.0 | 15.0 | 15.0 | | |
| | 1,3-Butane diol | | | | | 15.0 | |
| | 1,3-Propane diol | | | | | | 15.0 |
| Surfactant | Zonyl FS-300: | 2.0 | | 2.0 | | 2.0 | |
| | TEGO WET 270 | | 2.0 | | 2.0 | | 2.0 |
| Deionized water | | Balance | Balance | Balance | Balance | Balance | Balance |
| Total | | 100 | 100 | 100 | 100 | 100 | 100 |
| Mass ratio (urethane resin particle/acrylic resin particle) | | 0.40 | 0.40 | 0.33 | 0.40 | 0.20 | 0.45 |
| Martens hardness ($N/mm^2$) | | 66 | 71 | 117 | 34 | 89 | 50 |
| Amount of resin particle/amount of organic solvent to which (*) is attached | | 1.40 | 1.40 | 1.60 | 1.40 | 0.86 | 0.97 |

| | | Ink | | | | |
|---|---|---|---|---|---|---|
| | | 7 | 8 | 9 | 10 | 11 |
| Coloring material | Cyan pigment dispersion | | 45.0 | | 45.0 | |
| | Magenta pigment dispersion | 45.0 | | 45.0 | | 45.0 |
| Urethane resin particle | Urethane resin particle 1 (Tg: −20 degrees C.) | 0.3 | | 2.0 | 3.0 | 2.0 |
| | Urethane resin particle 2 (Tg: 25 degrees C.) | | | | | |
| | Urethane resin particle 3 (Tg: 90 degrees C.) | | | | | |
| Acrylic resin particle | Styrene acrylic resin particle (Tg: 104 degrees C.) | 7.0 | 5.0 | | | |
| | Acrylic silicon resin particle (Tg: 0 degrees C.) | | | | 3.0 | |
| Filler | White carbon pigment dispersion | | | 8.0 | | |

TABLE 1-continued

| | | | | | | |
|---|---|---|---|---|---|---|
| Organic solvent | N,N-dimethyl-β-butoxy propionamide (*) | 5.0 | 5.0 | | 5.0 | 5.0 |
| | N,N-dimethyl-β-ethoxy propionamide (*) | | | | | |
| | 3-ethyl-3-hydroxymethyl oxetane (*) | | | | | |
| | Diethylene glycol | 15.0 | 15.0 | 15.0 | 15.0 | 15.0 |
| | 1,3-Butane diol | | | | | |
| | 1,3-Propane diol | | | | | |
| Surfactant | Zonyl FS-300: | | 2.0 | | 2.0 | |
| | TEGO WET 270 | 2.0 | | 2.0 | | 2.0 |
| Deionized water | | Balance | Balance | Balance | Balance | Balance |
| Total | | 100 | 100 | 100 | 100 | 100 |
| Mass ratio (urethane resin particle/acrylic resin particle) | | 0.04 | 0.00 | — | 1.00 | — |
| Martens hardness (N/mm$^2$) | | 121 | 122 | 72 | 29 | 19 |
| Amount of resin particle/amount of organic solvent to which (*) is attached | | 1.46 | 1.00 | — | 1.20 | 0.40 |

In Table 1, the product name, manufacturing company, and the preparation method of white carbon pigment dispersion are as follows:

Urethane resin particle 1: TAKELAC™ W6110, glass transition temperature: −20 degrees C., manufactured by Mitsui Chemicals, Inc.):

Urethane resin particle 2: TAKELAC™ W6110, glass transition temperature: 25 degrees C., manufactured by Mitsui Chemicals, Inc.):

Urethane resin particle 3: TAKELAC™ W6010, glass transition temperature: 90 degrees C., manufactured by Mitsui Chemicals, Inc.):

Styrene acrylic resin particle (GRANDOL PP-1000EF, manufactured by DIC Corporation)

Acrylic silicone resin particle (SYMAC® US480, manufactured by TOAGOSEI CO., LTD.)

Zonyl FS-300, manufactured by E. I. du Pont de Nemours and Company

TEGO WET-270, manufactured by Evonik

Preparation of White Carbon Pigment Dispersion

White carbon pigment dispersion having a pigment concentration of 15 percent by mass was obtained in the same manner as in Preparation Example of Cyan Pigment Dispersion except that Pigment Blue 15:3 was replaced with white carbon pigment (Nipsil, manufactured by Tosoh Silica Corporation).

Formation and Drying of Area to which Liquid is Applied

Example 1

Ink 1 was installed onto the image forming apparatus illustrated in FIG. 1 including the drying device illustrated in FIG. 8, an image portion as an example of the area to which liquid was applied was formed on both sides of the recording medium and dried. The formed image portion was a solid image with a resolution of 1,200 dpi. The recording medium was roll paper (Lumi Art Gloss 90 gsm, paper width of 520.7 mm, manufactured by Stroa Enso).

In addition, the temperature of the image portion and the surface form of the contact guiding roller at the contact of the image portion with the contact guiding roller were as follows:

Temperature of image portion: 98 degrees C.

Surface form: Rough (concavo-convex)

The temperature of the image portion in contact with the contact guiding roller was measured by a non-contact temperature (ES1B, manufactured by OMRON Corporation). In addition, the contact guiding roller was covered with a tape-like form member to which substantially spherical glass was attached to form the concavo-convex portion as the surface form of the contact guiding roller. The diameter of the substantially spherical glass varied in the range of from 20 to 200 μm.

Examples 2 to 12 and Comparative Examples 1 to 4

The image portions of Examples 2 to 12 and Comparative Examples 1 to 4 were formed and dried in the same manner as in Example 1 except that the ink, the temperature of the image portion, and the surface form were changed to those shown in Table 2.

Regarding the surface form shown in Table 2, plane means that no tape-like form member was used to cover the contact guiding roller and has no concavo-convex portions as the surface form.

The image portion obtained by forming and drying the image portion in Examples 1 to 12 and Comparative Examples 1 to 4 was evaluated about voids and abrasion resistance according to the following method and evaluation criteria.

Evaluation on Void

The image portion obtained by forming and drying the image portion was observed by an optical microscope (×50) and visually checked and the state of peeling off of the image was classified and evaluated according to the following evaluation criteria. Rank A or B means evaluated as practical. The results are shown in Table 2.

Evaluation Criteria

A No image peeling-off was confirmed by optical microscope (×50)

B No image peeling-off was not visually confirmed but by optical microscope (×50)

C Image peeling-off was visually confirmed

Evaluation on Abrasion Resistance

The image portion obtained by forming and drying the image portion was abraded by paper (Lumi Art Gloss, 930 gsm) cut to have a size of 1.2 cm×1.2 cm 20 times. Ink contamination transferred to the paper was measured by a reflection type color spectrodensitometer (manufactured by X-Rite) and the concentration of the ink contamination was calculated subtracting the color of backdrop of the abraded paper. The calculated concentration of the ink contamination was classified according to the following evaluation criteria to evaluate abrasion resistance. A or B is preferable. The results are shown in Table 2.

Evaluation Criteria

A: Concentration of ink contamination is less than 0.1

B: Concentration of ink contamination is from 0.1 to less than 0.2

C: Concentration of ink contamination is 0.2 or greater

TABLE 2

| | Example | | | | | | |
|---|---|---|---|---|---|---|---|
| | 1 | 2 | 3 | 4 | 5 | 6 | 7 |
| Ink | 1 | 2 | 3 | 4 | 5 | 6 | 1 |
| Martens hardness ($N/mm^2$) | 66 | 71 | 117 | 34 | 89 | 50 | 66 |
| Temperature at image portion (degrees C.) | 98 | 98 | 98 | 98 | 98 | 98 | 122 |
| Surface form of roller | Concavo-convex | Concavo-convex | Concavo-convex | Concavo-convex | Concavo-convex | Concavo-convex | Concavo-convex |
| Void | A | A | A | B | A | A | B |
| Abrasion resistance | A | A | B | A | A | A | A |

| | Example | | | | | | |
|---|---|---|---|---|---|---|---|
| | 8 | 9 | 10 | 11 | 12 | 13 | 14 |
| Ink | 1 | 1 | 1 | 1 | 8 | 9 | 11 |
| Martens hardness ($N/mm^2$) | 66 | 66 | 66 | 66 | 121 | 122 | 72 |
| Temperature at image portion (degrees C.) | 58 | 98 | 120 | 60 | 98 | 98 | 98 |
| Surface form of roller | Concavo-convex | Plane | Concavo-convex | Concavo-convex | Concavo-convex | Concavo-convex | Concavo-convex |
| Void | B | B | A | A | A | A | A |
| Abrasion resistance | A | B | A | A | C | C | A |

| | Comparative Example | |
|---|---|---|
| | 1 | 2 |
| Ink | 7 | 10 |
| Martens hardness ($N/mm^2$) | 29 | 19 |
| Temperature at image portion (degrees C.) | 98 | 98 |
| Surface form of roller | Concavo-convex | Concavo-convex |
| Void | C | C |
| Abrasion resistance | A | A |

The drying device of the present disclosure efficiently dries a liquid applied area foamed on a recording medium with a heating member (heater) and reduces occurrence of voids resulting from partial peeling-off of the liquid applied area.

Having now fully described embodiments of the present invention, it will be apparent to one of ordinary skill in the art that many changes and modifications can be made thereto without departing from the spirit and scope of embodiments of the invention as set forth herein.

What is claimed is:

1. A drying device comprising:

a plurality of heaters disposed along a direction of conveyance of a recording medium to which liquid is applied, the heaters being configured to heat the recording medium in a contact manner, wherein the recording medium is conveyed in contact with the heaters on a conveyance path including a first path on which the recording medium is conveyed in contact with the heaters for a first time and a second path on which the recording medium is conveyed in contact with at least one of the heaters for a second time, wherein a dried film of the liquid formed according to the following method has a Martens hardness of 30 N/mm$^2$ or greater at 120 degrees C.:

forming method:

the liquid is applied to a glass plate to form a film and the film is dried with a reduced pressure at 100 degrees C. for three hours to obtain the dried film having an average thickness of 5 μm.

2. The drying device according to claim 1, wherein the heaters are disposed at least partially curvedly or arcuately.

3. The drying device according to claim 1, further comprising at least one contact guiding member configured to guide the recording medium on the second path to contact the heaters.

4. The drying device according to claim 3, wherein the at least one contact guiding member is disposed between the heaters adjacent to each other.

5. The drying device according to claim 3, wherein the contact guiding member includes at least two contact guiding members, wherein two or more of the heaters are disposed between the at least two contact guiding members adjacent to each other.

6. The drying device according to claim 3, wherein the at least one contact guiding member contacts an area to which the liquid is applied of the recording medium.

7. The drying device according to claim 6, wherein the at least one contact guiding member is movable between a first position where the at least one contact guiding member presses the recording medium against the heaters and a second position where the at least one contact guiding member does not press the recording medium against the heaters.

8. The drying device according to claim 6, wherein a temperature of the area to which the liquid is applied is 60 to 120 degrees C. at a contact with the at least one contact guiding member.

9. The drying device according to claim 3, wherein the at least one contact guiding member has a rough surface.

10. The drying device according to claim 3, wherein a substantially spherical body having a diameter of from 20 to 200 μm is disposed on a surface of the at least one contact guiding member.

11. The drying device according to claim 1, wherein the liquid comprises a urethane resin and an acrylic resin, and a mass ratio (amount of the urethane resin to amount of the acrylic resin) of an amount of the urethane resin in the liquid to an amount of the acrylic resin in the liquid is from 0.1 to 0.5.

12. The drying device according to claim 1, wherein the Martens hardness is from 35 to 120 N/mm$^2$.

13. The drying device according to claim 1, wherein, of the heaters, a heater disposed furthermost downstream on the first path in the direction of conveyance of the recording medium has a largest diameter of the heaters.

14. An image forming apparatus comprising:

the drying device of claim 1;

a liquid accommodating device configured to accommodate the liquid; and a liquid application device to apply the liquid to the recording medium.

15. An image forming apparatus comprising:

a first liquid application device configured to apply liquid to a first surface of a recording medium;

a first drying device disposed downstream of the first liquid application device in a direction of conveyance of the recording medium, the first drying device comprising the drying device of claim 1;

a second liquid application device disposed downstream of the first drying device in the direction of conveyance of the recording medium, the second application device configured to apply the liquid to a second surface of the recording medium opposite to the first surface; and a second drying device disposed downstream of the second liquid application device in the direction of conveyance of the recording medium, the second drying device comprising the drying device of claim 1, wherein the plurality of heaters of the first drying device contact the second surface of the recording medium on the first path, wherein the plurality of the heaters of the second drying device contact the first surface of the recording medium on the first path, wherein a dried film of the liquid formed according to the following method has a Martens hardness of 30 N/mm$^2$ or greater:

forming method:

the liquid is applied to a glass plate to form a film and the film is dried with a reduced pressure at 100 degrees C. for three hours to obtain the dried film having an average thickness of 5 μm.

16. The image forming apparatus according to claim 15, wherein each of the first drying device and the second drying device further comprises at least one contact guiding member configured to guide the recording medium on the second path to contact the plurality of heaters.

17. The image forming apparatus according to claim 16, wherein the at least one contact guiding member contacts an area to which the liquid is applied of the recording medium.

* * * * *